US006012405A

United States Patent [19]

Melton et al.

[11] Patent Number: 6,012,405

[45] Date of Patent: Jan. 11, 2000

[54] METHOD AND APPARATUS FOR AUTOMATIC ADJUSTMENT OF THREAD TENSION

[75] Inventors: Randall Melton, Las Vegas, Nev.; William R. Childs, Denver; Vernon Stephen Turner, Arvada, both of Colo.

[73] Assignee: MCET, LLC, Lakewood, Colo.

[21] Appl. No.: 09/075,502

[22] Filed: May 8, 1998

[51] Int. Cl.[7] ..... D05B 47/04; D05B 45/00

[52] U.S. Cl. ..... 112/475.01; 112/254; 112/278

[58] Field of Search ..... 112/470.01, 470.04, 112/254, 255, 278, 155, 445, 475.01

[56] References Cited

U.S. PATENT DOCUMENTS

| | | | |
|---|---|---|---|
| 1,571,766 | 2/1926 | Fels . | |
| 3,035,426 | 5/1962 | Macqueen . | |
| 3,550,400 | 12/1970 | Peat et al. . | |
| 3,771,329 | 11/1973 | Krause | 66/78 |
| 4,289,087 | 9/1981 | Takenoya et al. | 112/254 |
| 4,301,757 | 11/1981 | Tonomura | 112/254 |
| 4,526,017 | 7/1985 | Shima | 66/71 |
| 4,708,002 | 11/1987 | Lonati | 66/40 |
| 4,712,390 | 12/1987 | Lonati | 66/54 |
| 4,723,423 | 2/1988 | Goller et al. | 66/71 |
| 4,787,217 | 11/1988 | Goller et al. | 66/71 |
| 5,020,461 | 6/1991 | Hanyu et al. | 112/278 |
| 5,174,132 | 12/1992 | Brandani | 66/54 |
| 5,174,133 | 12/1992 | Kawase et al. | 66/57 |
| 5,307,648 | 5/1994 | Forkert et al. | 66/207 |
| 5,311,751 | 5/1994 | Winter et al. | 66/207 |
| 5,311,752 | 5/1994 | Gille | 66/207 |
| 5,331,564 | 7/1994 | Barea | 364/470 |
| 5,369,966 | 12/1994 | Morita et al. | 66/132 R |
| 5,442,564 | 8/1995 | Merlini et al. | 364/470 |
| 5,473,913 | 12/1995 | Bogucki-Land | 66/207 |
| 5,511,392 | 4/1996 | Sawazaki et al. | 66/54 |
| 5,511,394 | 4/1996 | Shima | 66/232 |
| 5,515,701 | 5/1996 | Schubert | 66/204 |
| 5,606,875 | 3/1997 | Nishitani et al. | 66/77 |

FOREIGN PATENT DOCUMENTS

| | | |
|---|---|---|
| 62-176486 | 8/1987 | Japan . |
| 62-294895 | 12/1988 | Japan . |
| 4-73091 | 3/1992 | Japan . |
| 5-245285 | 9/1993 | Japan . |

*Primary Examiner*—Peter Nerbun
*Attorney, Agent, or Firm*—Sheridan Ross P.C.

[57] ABSTRACT

A computerized stitching apparatus that automatically controls thread tension is disclosed. In one embodiment, at least two factors are used to determine the desired thread consumption for the next stitch. A thread length encoder is used to determine the amount of thread actually consumed for a particular stitch. The operator must enter a desired thread length ratio or an equivalent factor related to desired thread length used for a particular stitch into the operator input device. Another factor such as speed, stitch length, fabric thickness, or stitch angle change is used with at least the operator's input to determine the desired thread consumption. The tension of the thread is adjusted by the stitch control system which will affect the actual thread consumed for the particular stitch.

46 Claims, 22 Drawing Sheets

METHOD AND APPARATUS FOR AUTOMATIC ADJUSTMENT OF THREAD TENSION

FIELD OF THE INVENTION

The present invention relates to stitching apparatuses and methods for lock-stitching and, in particular, to a computerized lock-stitch apparatus and method for automatic thread tension adjustment.

BACKGROUND OF THE INVENTION

Stitching apparatuses of various designs and configurations have been devised to form lock-stitches in fabric. A series of lock-stitches can be arranged on fabric to form an embroidery pattern. These embroidery patterns are programmed into a computer or stitching control system which moves the needle and fabric to lock-stitch a desired embroidery pattern. A top thread and a bobbin thread cooperate with the needle to form the lock-stitch in the fabric. The top thread originates from an upper side of the fabric while the bobbin thread originates from a lower side of the fabric. Modern embroidery apparatuses often have multiple needles per head with multiple heads per machine, with some embroidery apparatuses having 12 needles for each of 30 heads. Commonly each needle stitches a different color thread and each head embroiders a different piece of fabric. The corresponding needles on each head typically have the same color thread. Only one needle per head is active at any one time so that each head stitches the same color thread at the same time. But to simplify this description, primarily a single-needle, single-head, machine is discussed herein.

A proper ratio between the top thread and bobbin thread length is generally desirable for high quality and attractive stitching. The thread length ratio is affected by a tension ratio between the top and bobbin threads. The tension ratio affects the amount of top thread and bobbin thread length used for a particular stitch. It is known to adjust the resistance of a tensioning wheel to change the top thread tension and to adjust a spring and set screw on bobbin case to change the bobbin tension. Resistance is provided by the tensioning wheel and bobbin spring which can be varied in proportion to thread tension. Generally, tension for the top and bobbin threads is set by an operator for a particular thread only once at the beginning of stitching. The top thread tension can later be adjusted at the tensioning assembly, while the bobbin tension cannot be readjusted without stopping the machine. By changing the top thread tension the thread tension ratio can be adjusted because the bobbin tension is typically held constant. Changes in the tension ratio are reflected in changes in the thread length ratio. Research indicates that different stitches in an embroidery pattern require different tension ratios, but the prior art only allows manual adjustments at infrequent intervals.

The operator must observe the quality of the stitches while a pattern is being stitched to determine if the thread tension ratio is set properly. If the ratio is improper, it means either the top and/or bobbin thread tension requires adjustment. To correct the tension, the operator must manually adjust the top thread tension. When the proper thread tension ratio cannot be achieved by merely adjusting the top thread tension, the tension on the bobbin thread would require adjusting which would require stopping the stitching apparatus. Training is generally required for the operator to recognize problems with the tension ratio and for the operator to adjust the thread tension.

To assure the best quality stitch possible with infrequent tension adjustments, the tension for both top and bobbin threads are typically set too high. Excessive tension often leads to thread breakage. Additionally, excessive tension causes columns to be too narrow. This distortion can expose walking stitches meant to be concealed underneath. On the other hand, simply lowering the tension at the beginning of the pattern would cause some stitches to receive too little tension which would produce unsatisfactory embroidery such as looping. A general need is recognized to lower tension when required by some stitches in a pattern to avoid thread breakage and distortion, without decreasing the tension for other stitches.

It is known in the prior art of related fields to automatically adjust the present thread tension based upon past thread usage. For example, when an excessive amount of thread for past stitches has been consumed, the tension is increased. This type of tension adjustment does not take into account any of the unique factors related to lock-stitching or anticipate changes required for future stitches. Therefore, there is a need for methods which automatically control thread tension when performing lock-stitching.

Although the prior art describes manually adjusting the thread tension ratio in stitching apparatuses, manual adjustment of the tension ratio is undesirable because it requires trained operators, costly additional labor and may require the machine to be stopped. The infrequent tension adjustments in the prior art is problematic because different stitches in the embroidery pattern require different tensions to ensure uniform quality.

SUMMARY OF THE INVENTION

In accordance with the present invention, an apparatus for creating lock-stitches while automatically controlling tension applied to the thread during stitching is disclosed. The stitching apparatus includes a stitching control system, an operator input device, a tensioning assembly, a thread length encoder, and stitching machinery. An operator can adjust the top thread tension or the thread length ratio for column stitches with the operator input device. In response to the operator's input, the tensioning assembly adjusts the tension on the top thread under the direction of the stitching control system. The thread length encoder measures the top thread as the encoder wheel turns to obtain the actual thread length used for a particular stitch. Supervision is provided by the stitching control system which can change thread tension in the tensioning assembly while also controlling the stitching machinery. To determine the proper tensioning of the top thread while maintaining a proper thread tension ratio, the stitching control system uses input from the operator, past thread consumption and predictions of future tension requirements.

The thread length ratio between top and bottom threads is maintained by the stitching control system. By adjusting the tensioning assembly, a custom thread length ratio can be applied for each stitch or as required. Adjusting the thread length ratio is done by varying the tension applied to the top or bobbin thread. The tension can be adjusted either once per stitch or dynamically during a stitch to complement the mechanical surge suppression commonly provided by a check spring. The stitching control system can formulate different tensions for varied stitching patterns typically found in lock-stitch applications. Tension needed for the next stitch is determined using the difference between the desired thread length and actual thread length used for the last stitch and/or other factors. Some of the other factors which the stitching control system uses when determining the proper tension for the next stitch may include, but are not limited to, a speed of needle with respect to the fabric, a length of the next stitch, a thickness of the fabric, and an angle change between the last stitch and the next stitch.

In one embodiment, at least two factors are used to determine the desired thread consumption for the next stitch. A thread length encoder is used to determine the amount of thread actually consumed for a particular stitch. The operator must enter a desired thread length ratio or an equivalent factor related to desired thread length used for a particular stitch into the operator input device. Another factor such as speed, stitch length, fabric thickness, or stitch angle change is used with at least the operator's input to determine the desired thread consumption. The tension of the thread is adjusted by the stitch control system which will affect the actual thread consumed for the particular stitch.

In another embodiment, a method for stitching a lockstitch pattern which changes the tension applied to the thread at least twice is disclosed. Initially, the first magnitude of a first factor related to each of a first and second stitches is determined by the stitch control system. This first factor could, among other things, be based upon speed of the needle, length of the stitch, thickness of fabric, or angle between stitches. In the next step, a first control output is determined by the stitch control system using at least the first magnitude of the first factor. Next, the first control output is applied to a tensioning assembly which adjusts the tension of the thread to a first tension. The first stitch of the pattern having a first desired thread length is performed using that first tension. After the first stitch is performed, a second control output is determined using at least the first magnitude of the first factor where the second control output is different from the first control output. The second control output is applied to the tensioning assembly to adjust the tension of the thread to a second tension. Finally, a second stitch of the pattern having a second desired thread length is performed where the first and second desired thread lengths are different.

Another embodiment is an apparatus for stitching fabric while automatically controlling tension applied to thread which includes an operator input device, a tensioning assembly and a stitching control system. The operator input device includes, among other things, a readout for indicating a ratio between top thread length and bobbin thread length during column stitches. The stitching control system receives input from the operator input device (as indicated by the readout). This input received from the operator is used to control the tensioning assembly and the rest of the stitching machinery to produce the desired stitches in the fabric.

In another embodiment, a method for stitching a pattern having a plurality of stitches which adjusts the thread tension ratio automatically is disclosed. Each stitch includes a top thread length and a bobbin thread length. The operator inputs a first factor related to the selected top thread length and bobbin thread length using the operator input device. Next, a stitching control system receives operator input from the operator input device. A ratio between the top thread length and the bobbin thread length is obtained by adjusting tension applied to the thread using a control output from the stitching control system to the tensioning assembly. Finally, at least one stitch of the embroidery pattern is completed at that tension.

Based upon the foregoing summary, a number of important advantages of the present invention are readily discerned. Since an optimal tension can be calculated for each stitch, the stitching control system maintains proper top thread tension and a thread tension ratio for all variations in a stitching pattern which improves uniformity across a stitch job. Operators no longer need training to recognize poor tension ratios or how to manually adjust thread tension which reduces labor costs. Additionally, since factors other than past stitch performance are used to predict proper future tension, the adjustments to the tensioning assembly are more accurate.

Additional advantages of the present invention will become readily apparent from the following discussion, particularly when taken together with the accompanying drawings.

DETAILED DESCRIPTION OF THE PREFERRED EMBODIMENT

Figure 1:
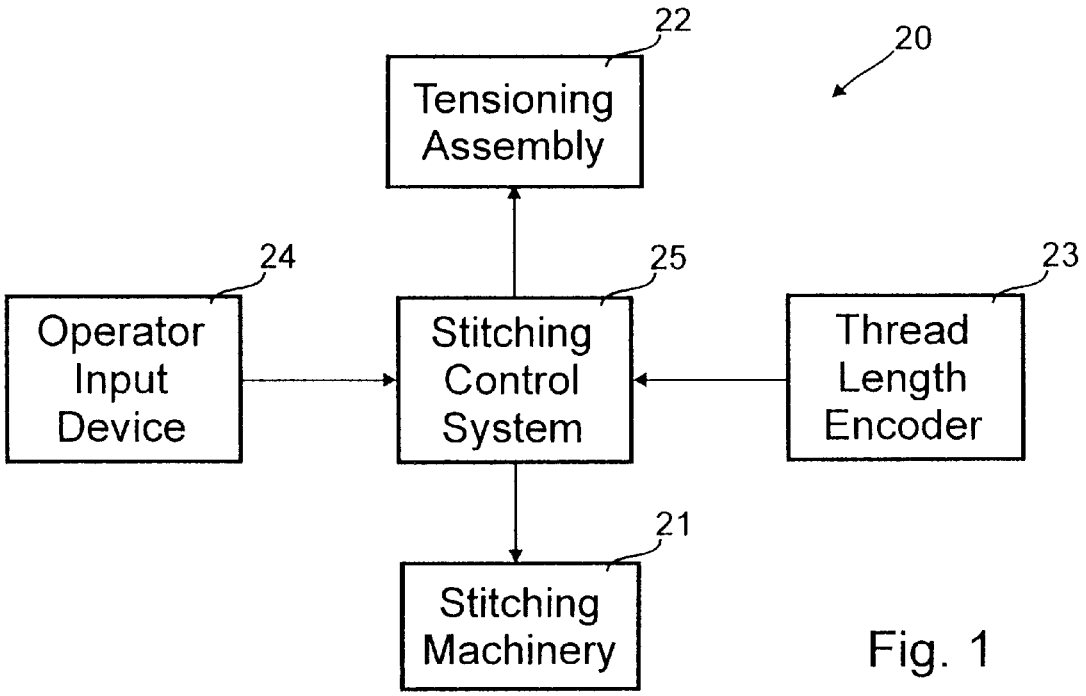
FIG. 1 depicts the top level block diagram of the embroidery apparatus with the stitching control system at the center.
Figure 2A:
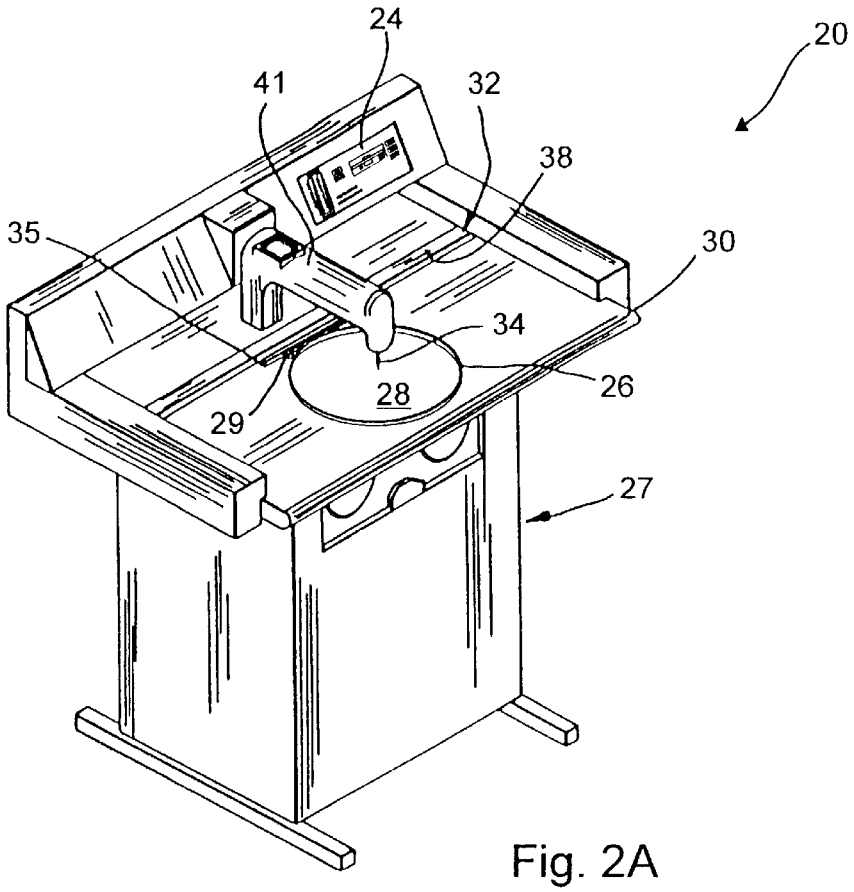
FIG. 2A is a perspective view showing a single head, single needle, stitching apparatus.
Figure 2B:
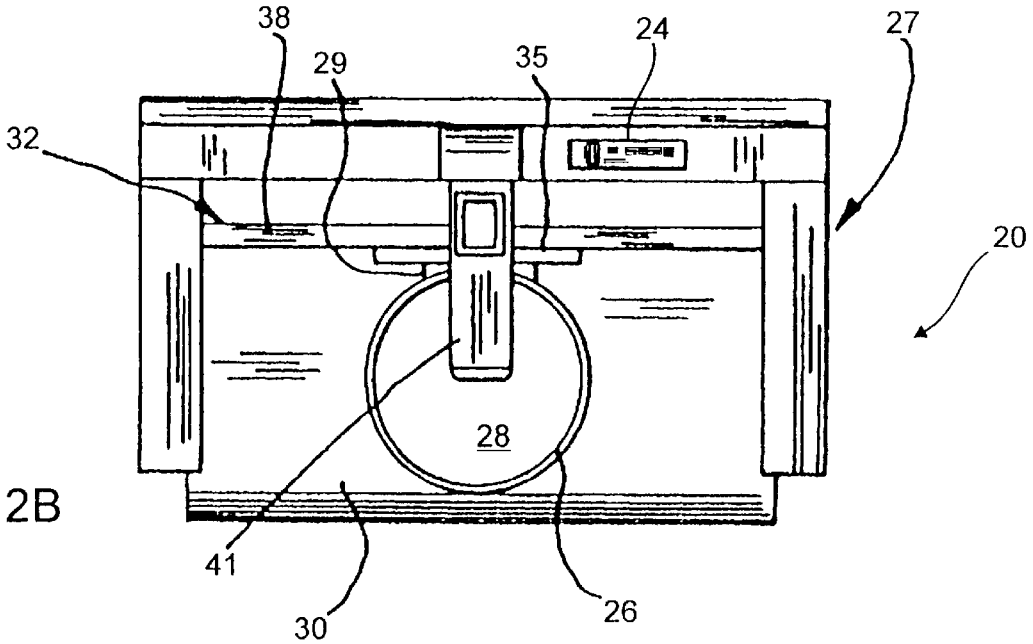
FIG. 2B is a top plan view of FIG. 2A.

With reference to FIG. 1, a block diagram of the major components of an embroidery apparatus is illustrated. The embroidery apparatus 20 contains a tensioning assembly 22, a thread length encoder 23, stitching machinery 21, an operator input device 24, and a stitching control system 25. The stitching control system 25 includes a computer which receives input from the operator input device 24 and thread length encoder 23. These operator inputs along with embroidery pattern information are used to determine how the stitching control system 25 will supervise the stitching machinery 21 and tensioning assembly 22 when performing the stitching.

The stitching machinery 21 in the preferred embodiment includes all the remaining items required to complete the stitching. This would include, among other things, a needle, actuators to move the fabric in two axes, thread guides, a pressor foot, a take up lever, a thread tie-off, thread break detectors, and a bobbin assembly. The stitching control system 25 supervises the stitching machinery 21 along with the tensioning assembly 22 while producing the series of lock-stitches which form the pattern.

In a preferred embodiment, the tensioning assembly 22 adjusts the resistance applied to an upper or top thread. A tension in the thread results from the application of resistance to the thread. The value of the tension for each thread and the ratio between the top and bobbin thread length is a critical factor for insuring stitch quality. Typically, the top thread tension is adjustable while the bobbin thread tension remains constant throughout a stitch job. Under these circumstances, the bobbin tension is preset to a value which allows automatically adjusting the top thread tension within a desired range during stitching to maintain the proper thread length ratio between the threads. Although, in another embodiment it may be possible to manipulate the bobbin tension while the top tension remains constant to achieve the desired thread length ratio.

The preferred embodiment measures consumption of the top thread as it passes the thread length encoder 23. Actual top thread consumption can be used by the stitching control system 25 to decide how to adjust the tensioning assembly 22 for future stitches to insure a proper thread length ratio. Other embodiments of this invention could use a thread length encoder 23 to measure the bobbin thread length used since only one of the threads requires measuring. If needed, the length of the other thread can always be calculated knowing the actual consumption of either thread. Alternatively in another embodiment, measuring the use of both top and bobbin thread could further improve control of the thread length ratio.

Either the top or bobbin thread can break during an embroidery pattern. Detecting these breaks and notifying the operator as soon as possible is important to keeping the stitching apparatus operating efficiently as well as not destroying the garment. The thread length encoder 23 can detect when either thread breaks because thread length used will vary outside a predetermined range. After detecting a break, the machine is stopped in order to allow the operator time to rethread the needle. In a multi-head machine, a break in the thread on one head will require stopping all heads until the thread is fixed because all heads work in unison.

The operator input device 24 is used to input stitching information into the embroidery apparatus 20. Embroidery patterns typically contain thousands of lock-stitches precisely arranged to form a pattern. This pattern is commonly entered into the operator input device 24 in electronic form, such as a removable diskette. In the preferred embodiment, the tension of the top thread or the ratio of top to bobbin thread length is controllable at the operator input device by pressing push buttons. In lieu of manual entry by the operator using push buttons, this information could be stored electronically on the removable diskette. Each head in a multi-head machine could have buttons to control the top thread tension or thread length ratio for that head so that each head could have a different top thread tension or thread length ratio.

The stitching control system 25 receives input from the operator input device 24 and thread length encoder 23. These inputs are processed to determine how to supervise the tensioning assembly 22 and stitching machinery 21 in order to stitch the desired embroidery pattern. To supervise the tensioning assembly 22, a control output with a magnitude is produced by the stitching control system 25. This control output is based upon predetermined information stored in memory relating to top thread length obtained from the operator input device 24. As the magnitude of the control output changes, so does the tension applied by the tensioning assembly 22 to the thread. Typically, one or more processors are used to implement the stitching control system 25.

Commonly in a multi-head embroidery apparatus, the stitching control system 25 would be divided between several locations. Portions of the stitching control system 25 might be located in each head to control the tension for that head, while another centrally located portion would analyze the stitching pattern to command each head how to properly set top thread tension. Preferably, various portions of the stitching control system 25 would communicate with each other using a high-speed serial data bus.

A detailed discussion of the mechanical operation of the mechanical portions of the apparatus is provided with reference to FIGS. 2–6. As is seen in FIGS. 2A–B, the apparatus includes a housing 27 for supporting the hardware required for proper operation of the present invention. A rectangular table 30 is mounted on the housing 27. The table 30 is provided to underlie and support fabric or other materials to be stitched. The fabric to be stitched is fastened to a hoop 26 which has an insert connector 29 attached to a portion of its periphery. The hoop 26 is used to keep the fabric 28 fixed in a plane perpendicular to the needle. The insert connector 29 is essentially a rod which has its ends inserted into openings formed in a x-carriage 35 of the carriage assembly 32 so that the hoop 26 and fabric 28 is attached thereto. A y-carriage 38 is also part of the carriage assembly 32. The y-carriage 38 overlies much of the x-carriage 35 and extends laterally across the width of the table 30. Stitching machinery is supported in a stationary manner above the fabric 28, and the threaded needle 34 extends vertically from the stitching head 41.

Each of the x-carriage 35 and y-carriage 38 are attached to stepping motors which move the hoop 26 in the plane perpendicular to the needle 34. The fabric 28 loaded into the hoop 26 moves in the x-axis and y-axis under the command of the control system 25. In this manner the movement of the needle 34 with respect to the fabric 28 is controlled to achieve a preprogramed lock-stitch pattern.

Figure 3:
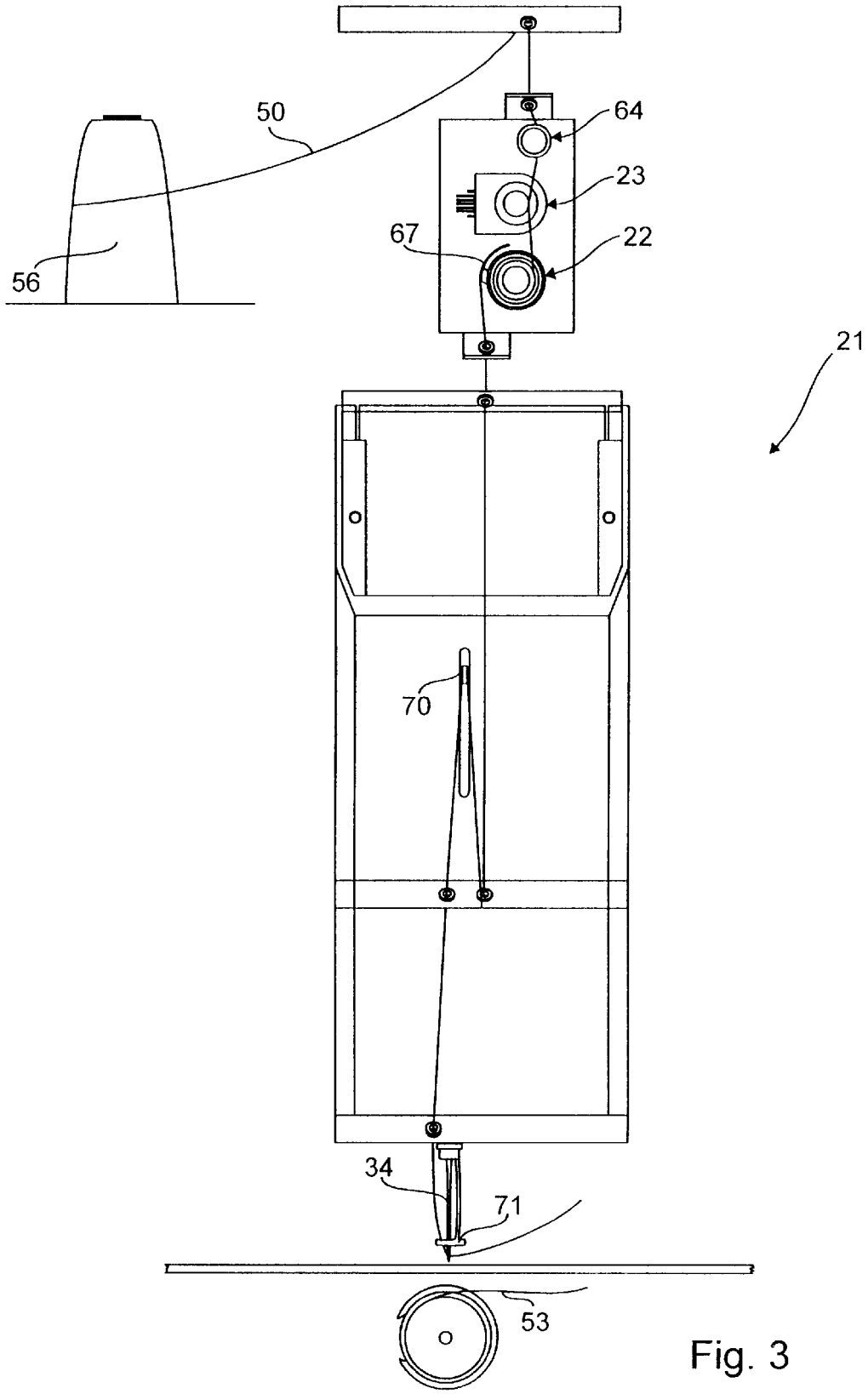
FIG. 3 depicts a front view of the stitching machinery which shows the top and bobbin thread paths and the tensioning wheels.

Referring to FIG. 3, the paths for a top and bobbin thread 50 and 53 are illustrated along with the associated stitching machinery. The top thread 50 starts at top spool 56 where it goes through thread guides and pre-tensioner 64. A nominal amount of resistance is applied to the top thread 50 by the pre-tensioner 64. Next, the top thread 50 passes around the thread length encoder 23 which measures the amount of thread 50 actually consumed and reports this length to the stitching control system 25. Then the top thread 50 is operatively engaged by the tensioning assembly 22. A variable amount of resistance is applied to the thread 50 by the tensioning assembly 22 under the command of the control system 25. A check spring 67 engages the thread at the tensioning assembly 22 and before a series of two more thread guides to act as a mechanical surge suppressor. A take-up lever 70 engages the thread between two more thread guides. Finally, the thread passes through another thread guide, a presser foot 71 and the needle 34.

Figure 4:
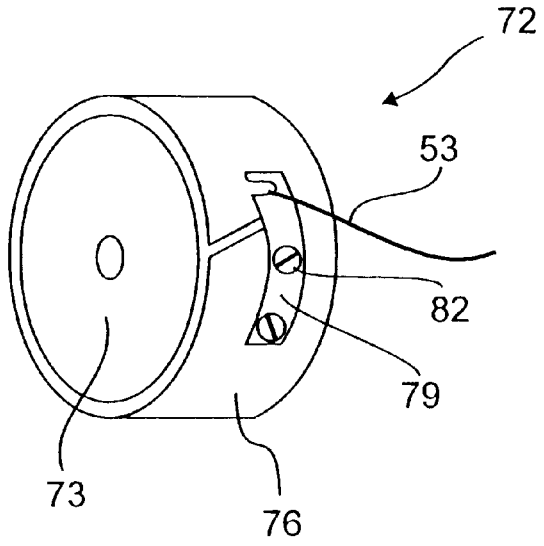
FIG. 4 is a perspective view of the bobbin and bobbin case which shows the spring and set screw used to adjust bobbin tension.

With reference to FIG. 4, a bobbin assembly 72 is shown in an expanded view. The bobbin assembly contains a bobbin 73, a thread 53, a case 76, and a spring 79 with a set screw 82. The bobbin 73 is used to wind a length of bobbin thread 53 around. Once the bobbin 73 is wound with thread 53 the bobbin 73 is placed inside the bobbin case 76. The thread 53 is routed out of the case 76 where it engages the spring 79 whose tension is adjustable with the set screw 82. By adjusting the set screw 82 which adjusts the spring, the resistance on the bobbin thread 53 is regulated as it leaves the bobbin assembly 72.

Figure 5:
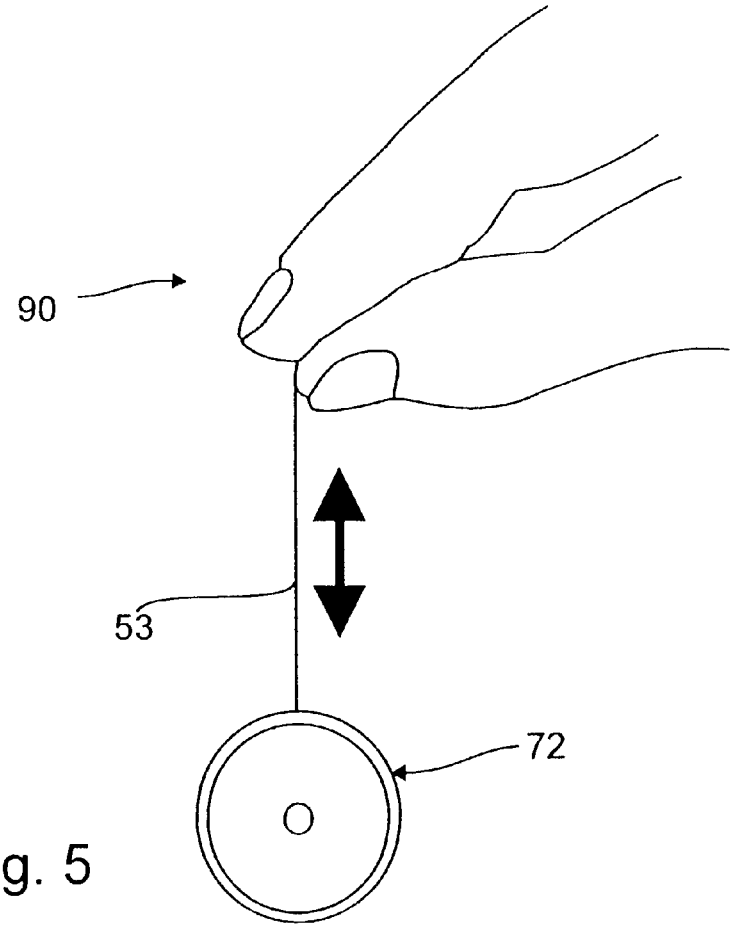
FIG. 5 is a view of an operator testing the bobbin tension.

Referring now to FIG. 5, the tension of the bobbin thread 53 is set once by the operator 90 before beginning a lock-stitch pattern. The bobbin thread 53 must have a tension setting so that when a desired tension ratio between top and bobbin thread is achieved, the tension in the top or bobbin thread is within an acceptable range to assure attractive stitching. Once the bobbin 73 is loaded into the case 76 and the set screw 82 is adjusted, the operator 90 suspends the bobbin 73 by the thread 53 and lightly jiggles the bobbin. Only a slight amount of thread 53 should unwind from the bobbin 73 while it is jiggled. To correct improper tension, the operator adjusts the set screw 82 and tests the tension again. This method of adjusting the bobbin tension is generally adequate, but alternatively, the operator 90 could attach a tension measuring device to the thread 53 in order to calibrate the tension more precisely.

Figure 6A:
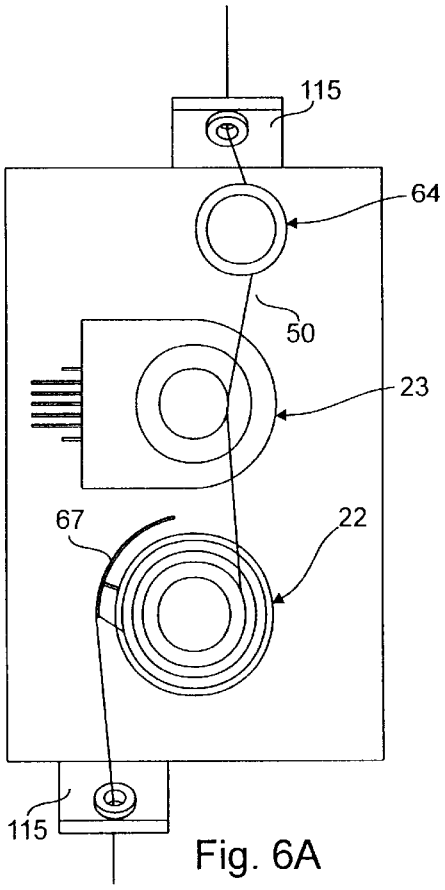
FIG. 6A is a front view depicting the pre-tensioner, thread length encoder and tensioning assembly.
Figure 6B:
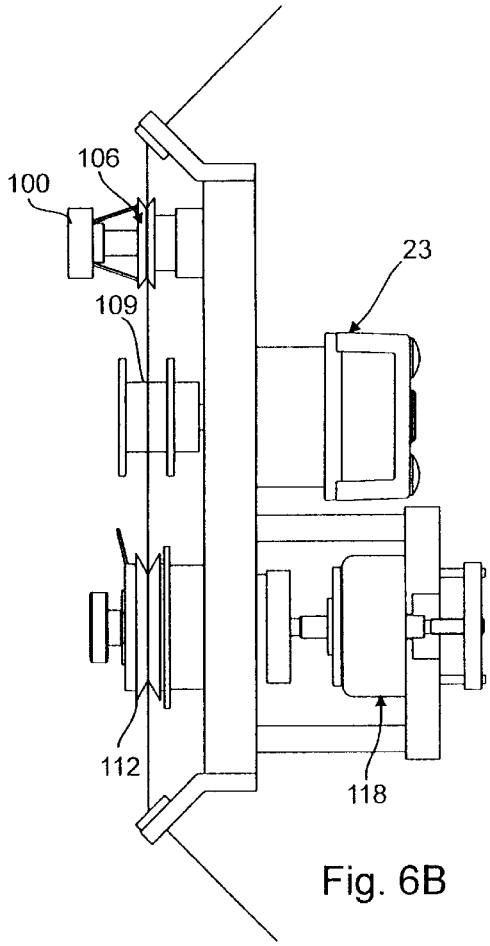
FIG. 6B is a side view of FIG. 6A.

In reference to FIGS. 6A–B, the pretensioner 64, the thread length encoder 23 and the tensioning assembly 22 are shown engaging the top thread 50. While threading the stitching apparatus, the top thread 50 is threaded through a pretensioning device 106, an encoder wheel 109 and tensioning wheel 112 at least once and passed through the thread guides 115 by the operator.

Initially, a small amount of resistance is applied to the thread 50 by the pretensioner 64 which creates tension on the thread. Pretensioner resistance can be manually adjusted using a pretensioning knob 100. The pretensioning device 106 includes two opposing convex washers that clamp down upon the thread 50 to create the resistance.

The tensioning assembly 22 can provide far more resistance on the top thread 50 than the pretensioner as commanded by the stitching control system 25. The operator 90 can control the tension applied to the top thread 50 by using the operator input device 24. To change the tension, a solenoid 118 reacts to a control signal provided by the stitching control system 25. Variations in the control signal are reflected in the pressure applied to the tensioning wheel 112 by the solenoid 118. In this way, the stitching control system 25 can adjust the tension in the top thread 50.

Incorporated into the tensioning assembly 22 is a check spring 67. One of the functions of the check spring 67 is to serve as a mechanical surge suppressor which absorbs large accelerations in thread usage. Other embodiments of this invention could dynamically adjust the tension applied to the thread 50 in order to complement the function of the check spring 67. This would require adjusting the thread tension a number of times during a particular stitch. A tension characteristic could be applied during each stitch which would be stored in the stitching control system 25.

The thread length encoder 23 measures the actual amount of thread 50 consumed as it rotates the encoder wheel 109 and conveys this information to the stitching control system 25. Knowing the amount of thread length actually used during stitching provides the feedback necessary to know if the tension of the top thread 50 is set properly to achieve a desired thread length ratio for column stitches.

The stitching control system 25 can use the information conveyed from the thread length encoder 23 to detect breaks in either the top or bobbin thread. If the top thread 50 breaks, a negligible amount of top thread will pass the thread length encoder 23. In other words, top thread consumption is approximately zero when the top thread breaks. When the bobbin thread 53 breaks the top thread consumption is equal to or less than the stitch length since there would be no bobbin thread to pull the top thread into the fabric 28. An algorithm within the stitching control system 25 can detect these conditions and notify the operator of the situation.

Figure 7:
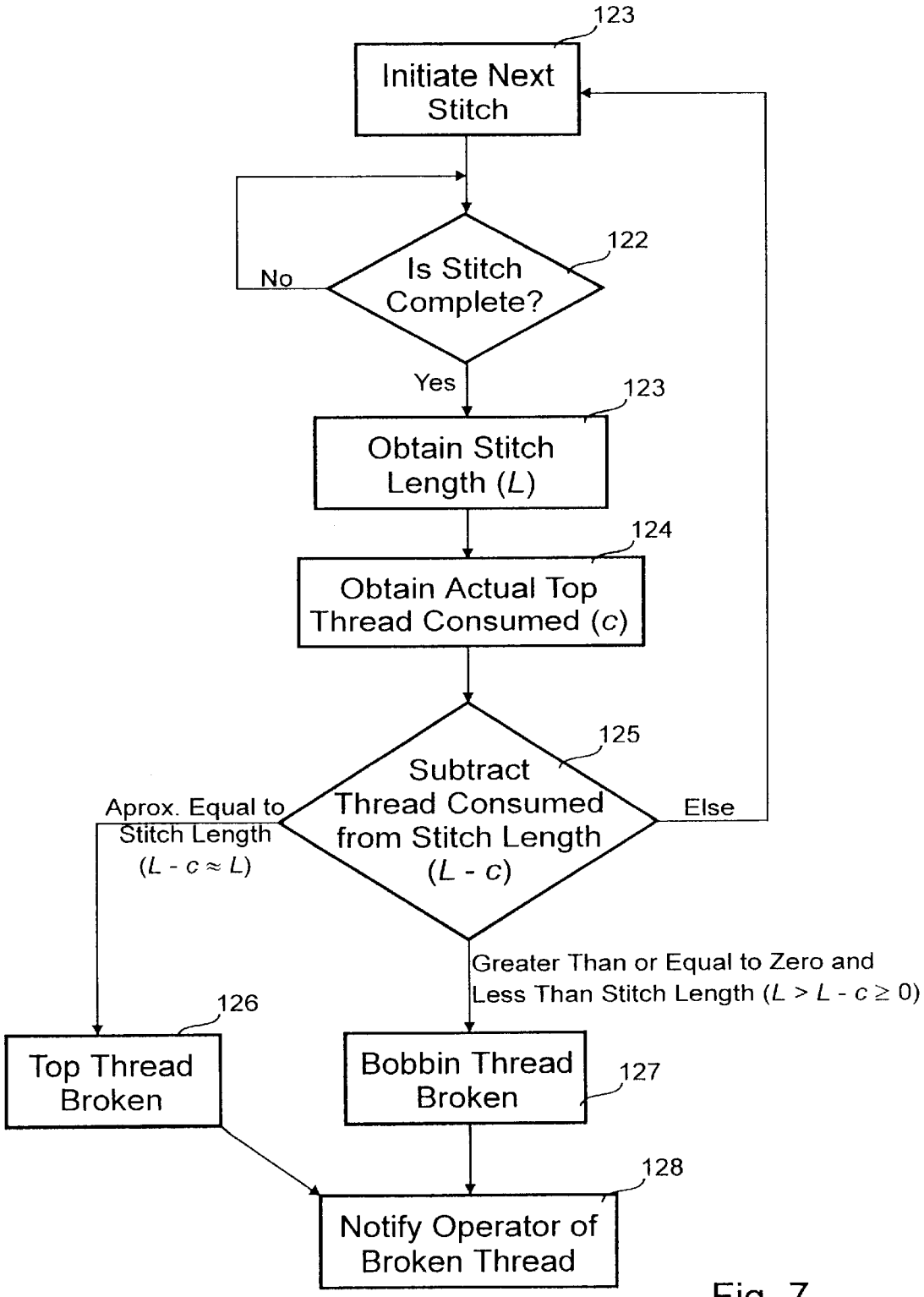
FIG. 7 is a flow diagram showing the steps for determining if either the top or bobbin thread has broken during stitching.

With reference to FIG. 7, a method for detecting thread breakage is disclosed. A benefit of this method for detecting thread breakage is that no additional hardware is required and all processing can be done by software within the stitching control system 25. The thread detection consists of the following steps: (1) after each stitch is completed as determined in step 122 the stitch length in step 123 and actual top thread consumed in step 124 are obtained; (2) for each stitch, the top thread actually consumed is subtracted from the stitch length to produce a result in step 125; (3) if the result is greater than or equal to zero but less than the stitch length, the bobbin thread is broken as realized in step 127, while if the result is approximately equal to the stitch length, the top thread is broken as realized in step 126; and (4) once it is determined which thread has broken, the operator is notified in step 128.

Figure 8A:
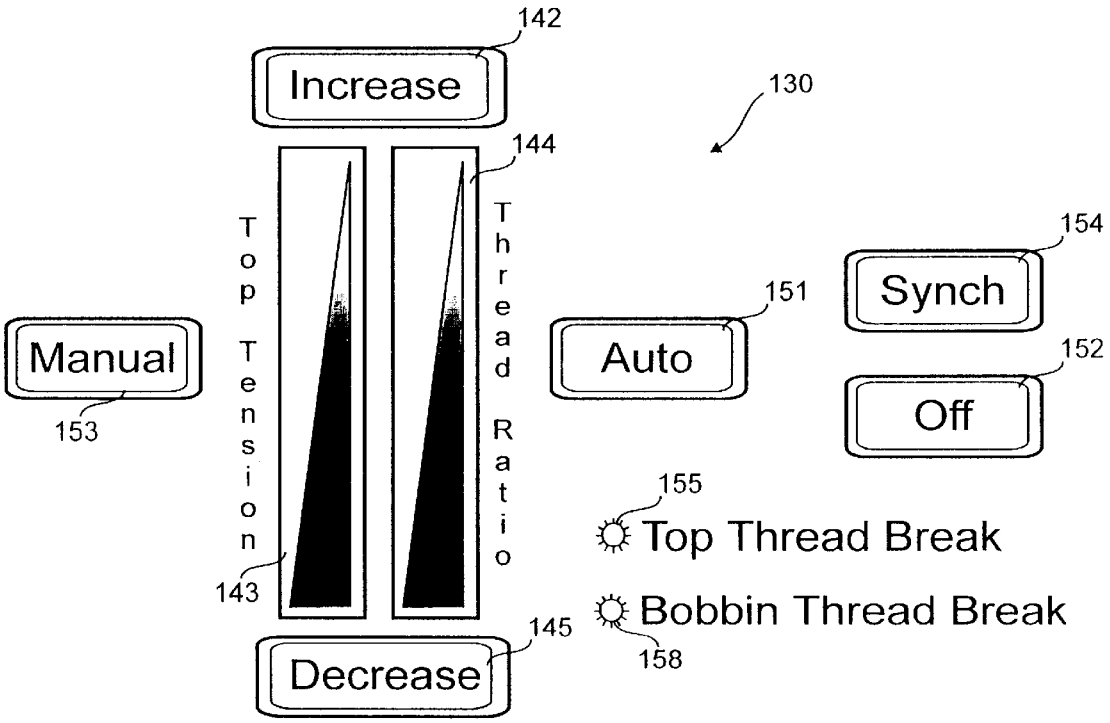
FIG. 8A is a front view of a portion of an operator input device for adjusting the tension ratio for a single stitching head, multiple head machines would have one of these for each head.
Figure 8B:
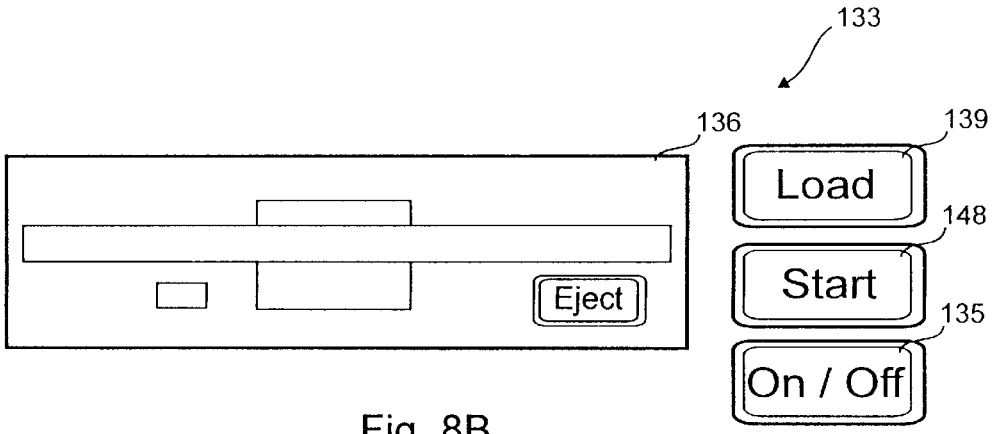
FIG. 8B is a front view of another portion of the operator input device for inputting the pattern from a removable disk, generally only one removable disk drive is required per embroidery machine.

The operator input device 24 is shown in FIGS. 8A and 8B. FIG. 8A depicts a head portion 130 of the operator input device 24 typical for each head 41 in a multi-head machine, while FIG. 8B depicts a machine portion 133 of the operator input device 24 that would commonly appear once on a multi-head machine. In order to begin stitching, the operator activates an on/off button 135 and inserts a removable disk into a removable disk drive 136 and presses a load button 139. For each head 41, the operator has to choose between operating in the automatic mode 151, manual mode 153 or disabling the head 152. Each head 41 in a multi-head machine is used to stitch the same pattern in unison with the others, but when there are more heads available than needed, some heads must be disabled by pressing the off button 152. After the mode is chosen at each head, the operator begins stitching by pressing the start button 148.

The ratio between top and bobbin thread consumption is maintained by the stitching control system 25 while in the automatic mode, i.e., the auto button 151 is activated. The top thread and bobbin thread lock together to form the stitch either above, inside or beneath the fabric as desired by the operator 90. In automatic mode, the operator 90 modifies the top to bobbin thread length ratio while stitching a column by adjusting a control member. The control member is controlled by pressing the increase and decrease buttons 142, 145. By looking at the thread length ratio readout 144, the operator can determine how pressing the buttons is affecting the system. The stitching control system 25 uses the desired thread length ratio to determine how to modify the tension applied to the top thread in order to achieve the desired ratio. During this process the stitching control system 25 uses the top tension readout 143 to indicate the top tension as a fraction of the dynamic range of the solenoid. Observing the top tension readout 143 can be useful to determine when the dynamic range in the solenoid is exhausted before achieving the desired ratio. For example, if the operator 90 inputs a 1.6 thread length ratio and the top tension readout 143 indicates 100% of the dynamic range of the solenoid is being used, it would generally mean the solenoid cannot supply enough tension to achieve the desired 1.6 ratio. In one possible solution, the operator 90 could stop stitching and decrease the tension applied to the bobbin thread 53 to effectively shift the range of the possible thread length ratios.

In manual mode the operator 60 can directly control the top tension. Manual mode is activated by depressing the manual button 153. Pushing the increase and decrease buttons 142, 145 in this mode will change the tension applied to the thread from the solenoid. By observing the top tension readout 143, the operator 90 can determine the current setting of the solenoid as a function of its dynamic range. The result of changes in top tension is reflected in the thread length ratio readout 144. As stitching occurs at the new tension, the stitching control system determines the thread length ratio while stitching a column and outputs this information to the readout 144. In this way, the operator 90 can know how adjusting the tension is affecting the ratio of top to bobbin thread consumption without stopping the machine to observe the underside of the fabric 28.

In another embodiment, there could be only one head portion 130 of the operator input device 24 for a multi-head machine. Adjustments made at the single head input device 130 would be effective for all heads. This would eliminate the need to have a control panel 130 at each head. An error indicator at each head could notify the operator 90 if the dynamic range of the active solenoid for that head were exceeded or a thread break had occurred.

In cases where there are control panels 130 for each head 41, all heads could be synchronized by the operator by pressing the synch button 154. Activation of this feature would copy the settings of the current head to all other heads in the machine. In this way, adjusting the thread length ratio or top thread tension on one head would cause each head to receive the same settings. Since the settings could affect each head 41 differently, calibration may be required to assure the settings produced the same results in each head. This button would eliminate the need for the operator to individually configure each head in a multi-head machine. As some stitching machines have as much as 30 heads, this feature becomes important.

FIG. 8A also depicts status indicator lights which signal the operator of a top thread break 155 or bobbin thread break 158 after detection. An audible alarm could be used in conjunction with status indicator lights 155, 158 if necessary.

Figure 9:
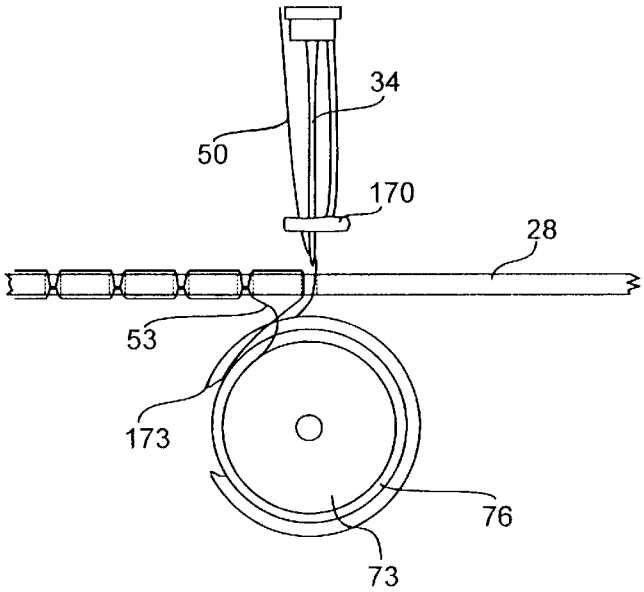
FIG. 9 is a front view of the needle interacting with the fabric and threads in which a series of straight line stitches are shown.

Now referring to FIG. 9 which shows the interaction between the needle 34, the presser foot 71, the fabric 28, the bobbin case 76, the bobbin 73, a rotary hook 173, and the top and bobbin threads 50, 53 to form a series of straight line lock-stitches. The first step is to push the needle 34 through the fabric 28 where the rotary hook 173 portion of the bobbin case 76 engages a loop formed in the top thread 50. As a result of the rotary hook 173 rotating in a counter-clockwise direction, the loop in the top thread is enlarged while simultaneously being pulled around the bobbin 73 and bobbin thread 53 which both remain stationary. Ultimately, the hook 173 releases the top thread 50 and the excess thread is pulled back from above the fabric 28 by the take-up lever 70 and check spring. This process interlocks the two threads and forms a lock-stitch in the fabric 28.

A detailed discussion of various lock-stitches commonly used in embroidery is provided with reference to FIGS. 10A–11C. Most embroidery patterns contain a combination of columns, straight-line, and circular walk stitches. Column stitches are common in embroidery patterns as most alphanumeric characters are formed with column stitches, while straight-line stitches are typically used when performing fill patterns or walking stitches.

Each stitch can be thought of as a vector with an angle and stitch length 177. The difference between the last stitch angle and the next stitch angle is called the stitch angle change 179. Typically, column stitches have stitch angle changes 179 of nearly 180° while straight-line stitches have angle changes 179 which are close to zero degrees.

Figure 10A:
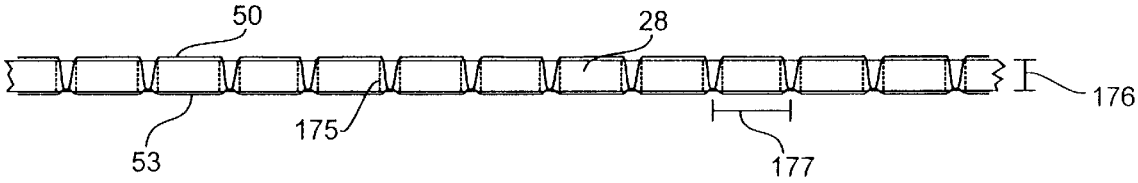
FIG. 10A is a side cross-sectional view of a series of straight-line or walking stitches.
Figure 10B:
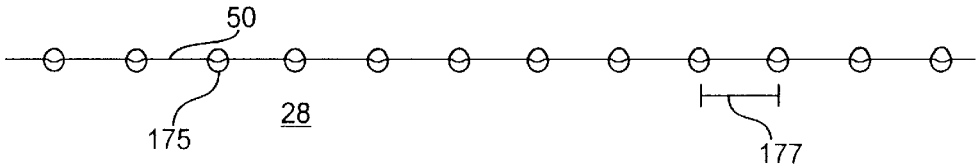
FIG. 10B is a top view of a FIG. 10A.

Referring to FIGS. 10A–B, a series of straight-line or walking stitches are depicted from the side and cross section top views. The top thread 50 and bobbin thread 53 engage each other within needle puncture holes 175 which are formed inside the fabric 28 to create the lock-stitches. The bobbin thread 53 consumption is roughly equal to a stitch length 177, while the top thread consumption is generally equal to the stitch length 177 plus twice a fabric thickness 176. A view from above the series of stitches (see FIG. 10B) shows the needle punctures 175 in the fabric 28 and the top thread 50. Although not shown, tension upon the top thread 50 could be increased so that the bobbin thread 53 would loop into the needle puncture holes such that the top thread consumption would generally be equal to stitch length 177. In this case, the bobbin thread would be visible from the top of the fabric and would create visible imperfections within the embroidery pattern. Control of the ratio between top and bobbin thread length helps insure that the bobbin thread is not visible from the top of the fabric.

Figure 11A:
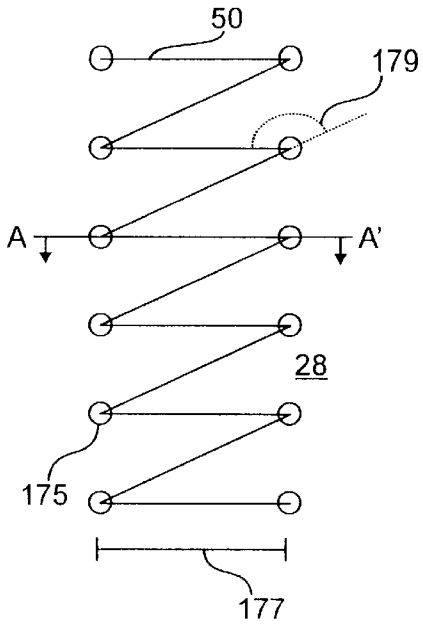
FIG. 11A is a top view of a series of stitches which form a column embroidery pattern.
Figure 11B:
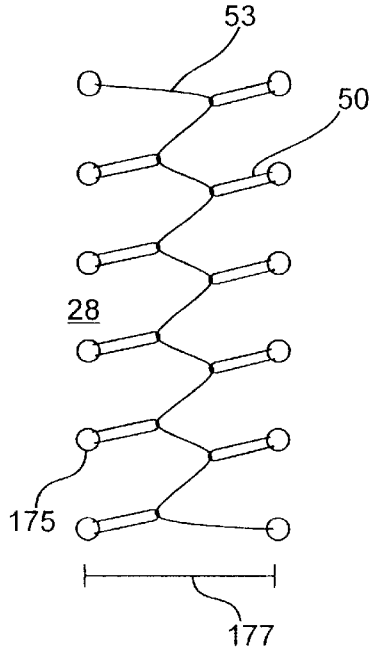
FIG. 11B is a bottom view of FIG. 11A showing the top and bobbin thread underneath the fabric.
Figure 11C:
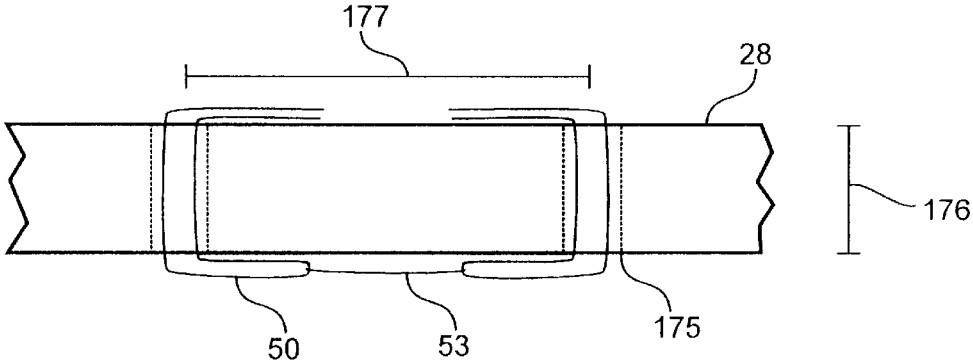
FIG. 11C is a side view of FIG. 11A along the line A–A'.

FIGS. 11A–C depict a series of stitches which form an embroidery column. Column patterns are characterized by stitch angle changes which approach 180°. The thread length ratio between top thread 50 and bobbin thread 53 will determine how much of the top thread is visible from underneath the fabric when stitching columns. The operator 90 knows the setting of the thread length ratio by observing the readout 144 on the input device 24 (referring back to FIG. 8A). The case where the bobbin thread covers one-third of the distance underneath the fabric while the remaining two-thirds is covered by equal amounts of top thread on either side of the bobbin thread is shown in FIGS. 11A–C. The operator 90 using the input device 24 can adjust bobbin thread consumed when performing column stitches. Although not desirable, the top thread tension could be set so tightly that the bobbin thread 50 is visible from the top side of the fabric 28.

Figure 12:
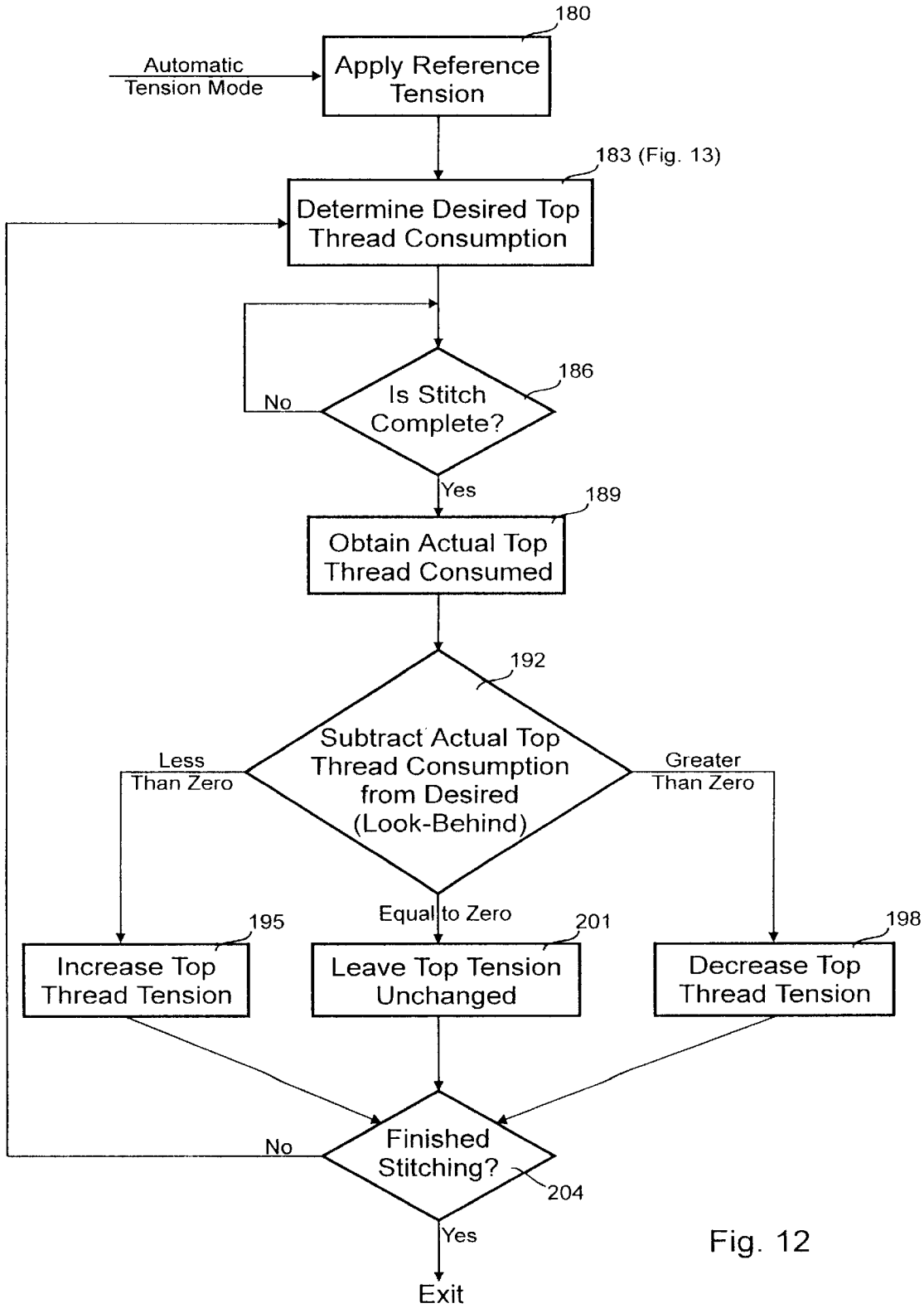
FIG. 12 is a flow diagram depicting the steps for automatically adjusting the thread tension for one embodiment.
Figure 13:
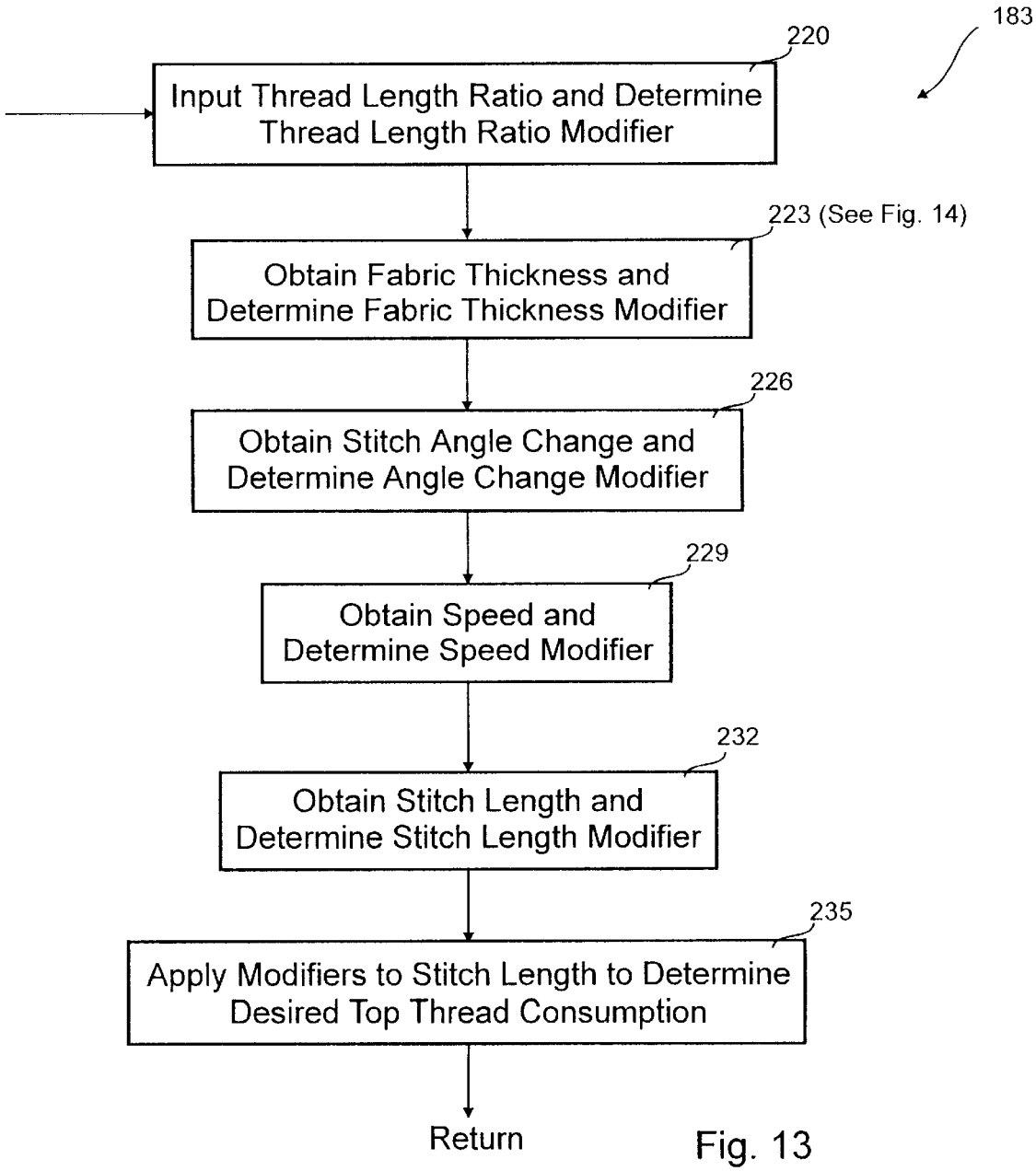
FIG. 13 is a flow diagram showing the steps for determining the desired top thread consumption.

The flow diagrams depicted in FIGS. 12–13 explain one embodiment of the current invention. Execution of the steps within each flow diagram would preferably be implemented with software operating within the stitching control system 25. The embodiment described uses past performance (i.e., look-behind analysis) coupled with future predictions of thread consumption (i.e., look-ahead analysis) to determine the tension for the next stitch. The look-behind analysis serves as feedback to more accurately predict future thread length use. Other embodiments could use either look-behind analysis or look-ahead analysis.

As illustrated in FIG. 12, one embodiment of automatic tension adjustment is described. When the stitching machinery is set to the automatic tensioning mode, the tension of the top thread is controlled by the stitching control system 25 by adjusting the friction applied to the top thread by the tensioning assembly 22. The stitching control system 25 sets the tension for a stitch based upon predicted changes required by future stitches (i.e., look-ahead factors) and/or the accuracy of past usage predictions (i.e., look-behind feedback). Additionally, tension applied to the top thread can be dynamically changed during a stitch to enhance the effectiveness of the check spring 67 located on the tensioning assembly 22.

Determining how to adjust the top thread to bobbin thread tension ratio takes several steps: (1) a reference tension is applied at step 180, (2) an desired top thread consumption is determined at step 183, (3) after a stitch is completed at step 186, an actual top thread consumption is obtained at step 189, (4) the actual top thread consumption is subtracted from the predicted at step 192 to produce a result, and (5) the result is used to either increase at step 195, decrease at step 198 or leave unchanged at step 201 the top thread tension.

Before the first stitch is performed a reference tension is applied to the top thread in accordance with step 180. This initial value is a typical tension unique to each stitching apparatus and represents a tension that generally produces results similar to the mechanical tension adjustment found in the prior art. The operator 90 could update the stored reference tension for each pattern or as required. As a convenience, an unique reference tension for each pattern could be loaded from the removable disk drive 136 at the same time the pattern is loaded. The reference tension is typically modified after performing the first stitch in steps 195, 198.

The next step 183 is for the stitching control system 25 to determine the desired top thread consumption required for the upcoming stitch. Determining the desired top thread consumption at step 183 requires evaluating how tension should change in preparation for the upcoming stitch. This process takes into account, but is not limited to, one or more of the following factors such as stitch length 177 of the next stitch, current fabric thickness 176, angle change between stitches 179, speed of the next stitch, and thread length ratio for column patterns desired by operator, as well as other possible factors.

After the stitch is completed in step 186, the stitching control system 25 obtains the actual top thread consumed in step 189 from the thread length encoder 23. The thread length encoder 23 measures the actual consumption as the thread rotates the encoder wheel 109. Thread consumption is used as feedback into the stitching control system 25 to determine how accurately the applied top thread tension produced the desired top thread consumption.

Next the actual thread consumption obtained at step 189 is subtracted from the desired thread consumption determined at step 183 by the stitching control system 25 (i.e., look-behind evaluation). The variance between the desired thread consumption and the actual thread consumption is determined to produce a result in step 192. The result indicates how close the actual thread tension is to the desired thread tension.

After determination of the variance in step 192, the result is used with the increase step 195, decrease step 198 or leave unchanged step 201, because the actual top thread consumed 189 is respectively too long, too short or correct. There are three possible actions taken based upon the result of subtracting actual thread consumed from predicted: (1) when the result is less than zero the top thread tension must be increased at step 195 because actual top thread consumption provided at step 189 exceeded the desired thread consumption provided at step 183; (2) when the result is greater than zero the top thread tension must be decreased at step 198 because predicted desired top thread consumption provided at step 183 exceeded the actual of step 189; and (3) when the actual top thread consumed of step 189 is equal to the desired provided at step 183, the top thread tension remains unchanged. Tension for the top thread could be adjusted in proportion to the variance between desired and actual thread consumption. A limit on the amount of top thread tension adjustment at any one time may be helpful to dampen any large swings in top thread tension.

The final step after adjusting the top thread tension is to determine if the embroidery pattern is complete. If more stitches are required, the automatic tension adjustment process will begin again at step 183 and be repeated for each stitch. Following these steps will provide for higher quality stitching throughout the whole stitching pattern because the tension ratio between the top and bobbin threads is corrected after each stitch with the use of feedback.

In reference to FIG. 13, a process for determining desired top thread consumption 183 for the next stitch is shown. This process predicts thread consumption based upon anticipated changes required by future stitches (i.e., look-ahead factors). In an alternative embodiment (not shown), tension requirements of a number of future stitches could be analyzed when determining how to set the thread tension for the next stitch, rather than only using information from the next stitch.

Many factors can be considered and analyzed when determining the desired top thread consumption for the next stitch including, but not limited to, a desired thread length ratio at step 220, a fabric thickness 176 at step 223, a stitch angle change 179 between the last stitch and the next stitch at step 226, a speed of stitch at step 229, and a stitch length at step 232. To determine the desired top thread consumption at step 235, the factors are applied to the stitch length 177. The fabric thickness modifier determined at step 223 is added to the stitch length 177, while the angle change modifier determined at step 226, speed modifier determined at step 229 and stitch length modifier determined at step 232 are multiplied to determine desired thread consumption at step 235. The distance between needle punctures or stitch length 177 generally corresponds to the minimum amount of top thread that could be consumed for a stitch under normal circumstances. Other factors not accounted for in this embodiment which could affect thread consumption are thread elasticity, dynamic speed variation, type of fabric, needle type, configuration of thread path, dynamic tension change in the thread path, type of thread, and amount of thread left on spool.

A desired thread length ratio between the top thread and bobbin thread is entered by operator using the input device at step 220. By increasing or decreasing the thread length ratio, the operator 90 can modify the ratio between the top and bobbin thread consumption (referring back to FIG. 8A). A length ratio modifier is calculated from the operator's input at step 220. This modifier is ultimately applied to the stitch length 177 in an effort to achieve the operator's desired ratio.

Fabric thickness 176 (shown in FIG. 10A) is another factor which affects the desired top thread consumption. As the fabric thickness 176 increases, more top thread 50 tends to be required to maintain a desired thread length ratio. To counteract the effects of thickening fabric, the fabric thickness modifier 223 would increase the desired top thread length as the thickness of the fabric increased. In the process of calculating the desired top thread consumption of step 235, the fabric thickness modifier is added to the stitch length 177. Since the top thread must pass through the needle punctures 175 in the fabric 28 at each end of the stitch, the thickness modifier is generally less than or equal to twice the thickness of the fabric.

As the stitch angle changes between stitches 179 (depicted in FIG. 11A) the top thread consumption will also tend to change. FIGS. 10A–B depict a series of straight-line stitches where the angle change between stitches 179 is zero, whereas FIGS. 11A–C depict a column of stitches where the angle change 179 between stitches is nearly 180°. As the stitch angle change 179 varies from 0° to 180°, the top thread length tends to increase. A stitch angle change modifier determined in step 226 corrects for the effects of angle change 179 between stitches. In step 235 the stitch angle change modifier along with the other modifiers are applied to the stitch length 177 when determining the desired top thread consumption.

Each stitch is performed at a particular speed. When the needle speed is stationary, the fabric hoop 26 must move more quickly for larger stitches. The speed of the thread as it is delivered to the fabric 28 obtained in step 229 also increases for larger stitches. Depending on the configuration of the stitching machinery, the friction upon the top thread may be more affected by the speed increases than the friction upon the bobbin thread. As the friction increases upon the thread, the tension tends to increase which decreases thread usage. To combat the disproportionate increase in friction upon the top thread, a stitch speed modifier determined in step 229 would change the desired top thread consumption as the stitch speed increased.

The stitch length 177 is the distance between the needle punctures 175 in the fabric 28. The stitch length 177 generally corresponds to the minimum amount of top thread consumed for a particular stitch. Top thread consumption is affected by many factors which include the elasticity of the thread and the dynamic friction in the thread path, among other factors. Different types of thread have different elasticities. As stitch lengths 177 increase, the elasticity increases which tends to require less top thread. Short stitch lengths 177 have relatively little elasticity which would tend to increase thread tension and require proportionately more top thread. The dynamic friction response can also affect the thread consumption. There are two components to the dynamic friction of each stitch: (1) the friction to start the thread moving and (2) the friction to keep the thread moving. With large stitches, the thread is consumed more quickly than with small stitches. As the thread moves faster through the stitching machinery, the resistance decreases along with the tension. This causes large stitches to tend to have less tension while small stitches tend to have more. To compensate for differing elasticities, dynamic friction and other factors associated with different stitch lengths 177, a stitch length modifier is calculated at step 232. This stitch length modifier is multiplied by the stitch length 177 in step 235 to determine the desired top thread consumption.

To determine the desired top thread consumption at step 235, the modifiers must be applied to the stitch length at step 232. The fabric thickness modifier determined at step 223 is added to the stitch length 177, while the angle change modifier determined at step 226, speed modifier determined at step 229 and stitch length modifier determined at step 232 are multiplied to determine the desired thread consumption at step 235. This calculation can be performed by the stitching control system 25 prior to performance of each stitch.

Figure 14:
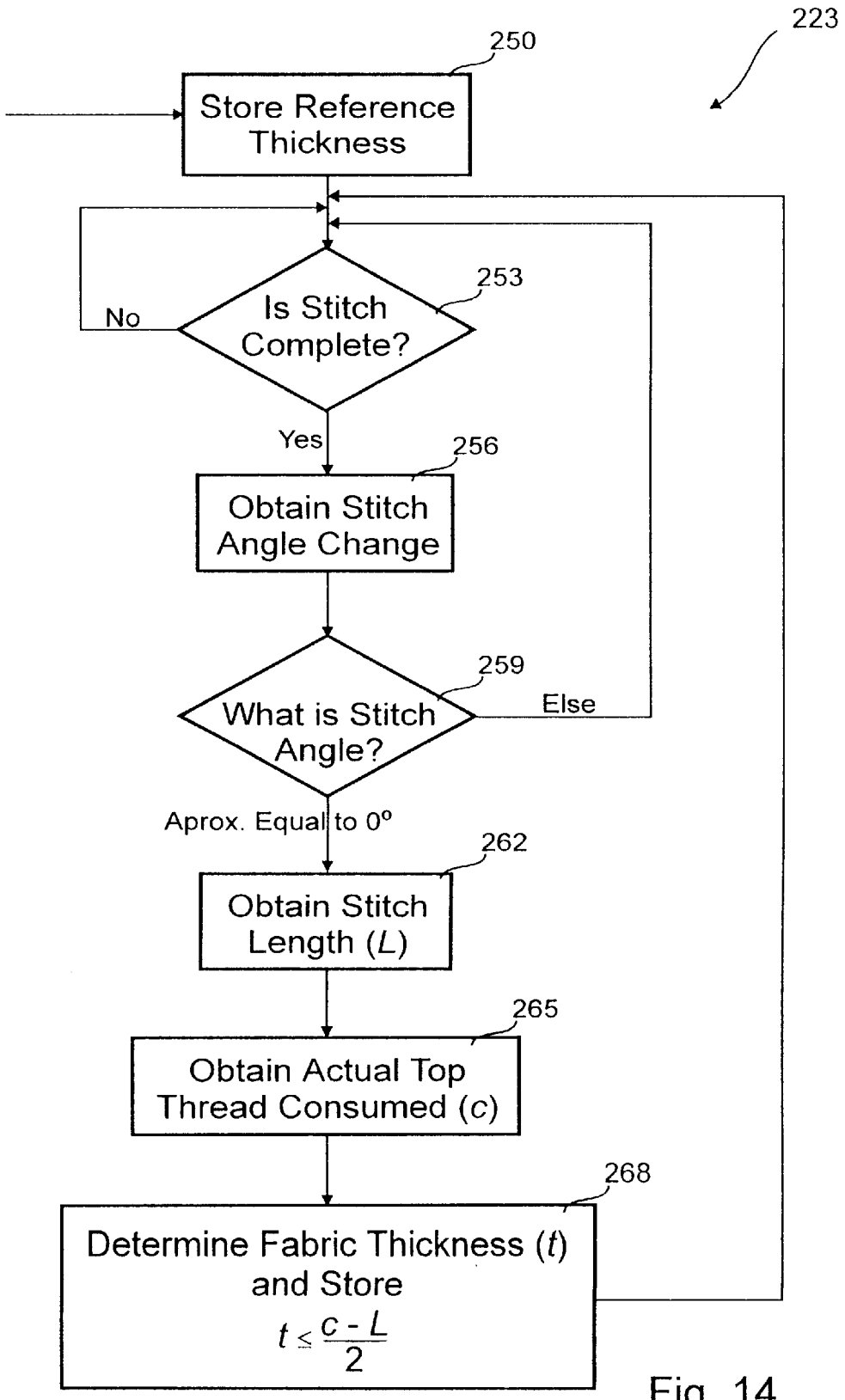
FIG. 14 is a flow diagram depicting the steps for determining the fabric thickness.

Referring to FIG. 14, a method for automatically determining the fabric thickness 176 is disclosed. An alternative to determining the fabric thickness 176 automatically would be to have the operator 90 manually input the fabric thickness 176 prior to the start of stitching. Fabric thickness 176 is required to determine the desired top thread consumption for the next stitch (see step 223 in FIG. 13). Automatic determination of fabric thickness 176 includes the following steps: (1) storing a reference thickness prior to beginning stitching at step 250; (2) waiting for a stitch to complete at step 253 before obtaining the stitch angle change at step 256; (3) if the stitch angle is approximately equal to zero degrees 259, the stitch length of step 262 and top thread actually consumed of step 265 are used to determine fabric thickness at step 268. The fabric thickness 176 is less than or equal to the difference between the top thread consumption and stitch length 177 divided by two. This fabric thickness algorithm only works when the stitch angle is approximately zero. Dynamic variance in fabric thickness is accounted for since the calculation can be performed for each roughly zero-angle stitch. It should be noted that apparent fabric thickness will vary as the tension changes which will affect the accuracy of this calculation. For example, as tension increases the elasticity in the thread allows it to stretch which reduces actual thread consumption in step 265. This apparent fabric thickness change will skew the results.

Figure 15A:
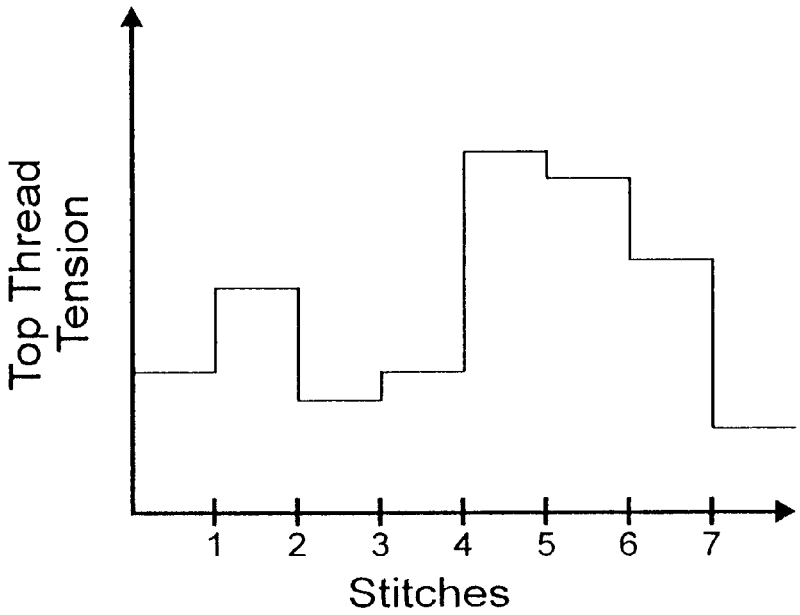
FIG. 15A is a chart showing top thread tension as it varies for each stitch, where tension is changed only once for each stitch.
Figure 15B:
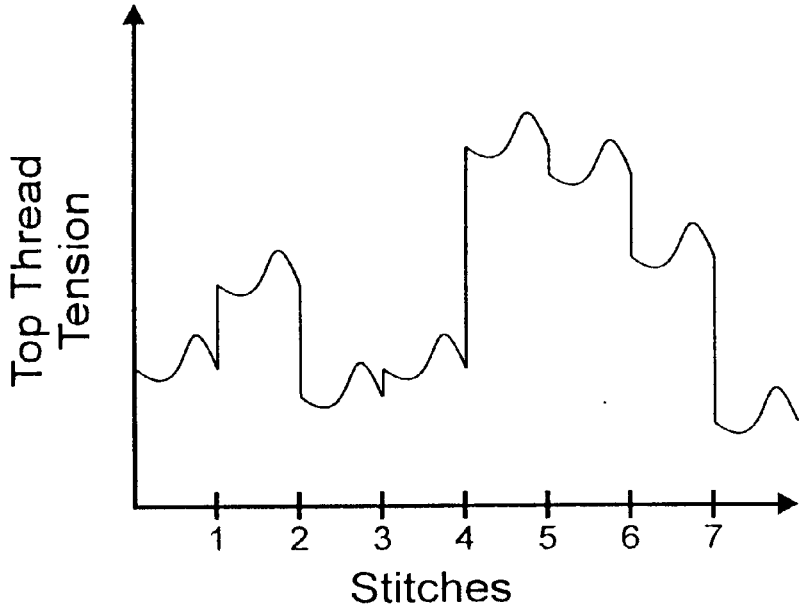
FIG. 15B is a chart showing an example of the varying top thread tension during each stitch, where tension is dynamically changed multiple times during each stitch.

Now referring to FIGS. 15A–B, the variance of top thread tension during each stitch is shown. FIG. 15A depicts a simpler embodiment where the tension is adjusted once for each stitch and is held constant during the stitch. This embodiment requires a check spring (67 in FIG. 3) which works as a mechanical surge suppressor to vary the tension dynamically during the stitch. This check spring 67 serves to smooth-out thread feed, allow for varying stitch length and help "set" the previous stitch. The check spring 67 normally extends in the direction of thread movement during the beginning of the stitch and recoils in the opposite direction toward the end of the stitch. It is believed, operation of the check spring serves to decrease thread tension at the beginning of the stitch while increasing the tension toward the end of the stitch.

FIG. 15B depicts one example of dynamic thread tension adjustment in another embodiment of this invention to complement the action of the check spring 67. During each stitch the stitching control system 25 could vary the resistance applied to the top thread by the tensioning assembly 22 to enhance the effectiveness of the mechanical check spring 67 or compensate for other factors. The thread tension in this embodiment may be decreased toward the beginning of the stitch and increased toward the end of the stitch according to a stored characteristic. With each stitch, the dynamic response characteristic is repeated. Depending upon the particular requirements of the stitching machinery, the dynamic tension response characteristic during each stitch could later be customized.

Referring to FIGS. 16A–E which depict a combined thread length encoder 23 and tensioning assembly 22 in another embodiment of the present invention. This combined assembly is called an auto-tensioning module 270 and includes: a retention cap 271, two friction washers 273, a thread wheel 275 which includes an encoder disk portion 274, a housing 281, an encoder assembly 276 which includes a sensor 277 and printed circuit board (PCB) 278, and a low-profile tensioning solenoid 279. The retention cap 271 keeps all the components in the module 270 joined together.

Tension is applied to the thread by the auto-tensioner module 270. The thread wheel 275 engages the thread so that the low-profile solenoid 279 can adjust the friction applied by the friction washers 273 to the thread wheel 275. When friction is applied to the thread wheel 275, the tension of the thread changes. Preferably, the friction washers 273 are made of felt or a similar material.

The encoder assembly 276 within the auto-tensioner module 270 is used to determine the actual thread consumption. Whenever the thread wheel 275 rotates so does the encoder disk portion 274 which is impregnated with magnetic material. The encoder sensor 277 measures the magnetic field generated by the encoder disk 274 to determine the amount of rotation and reports that information to the stitching control system 25. Knowing the amount of rotation of the thread wheel allows the stitching control system 25 to calculate the actual thread consumption. Preferably, the encoding sensor 277 is a hall-effect sensor, but could also be an optical sensor.

Figure 16A:
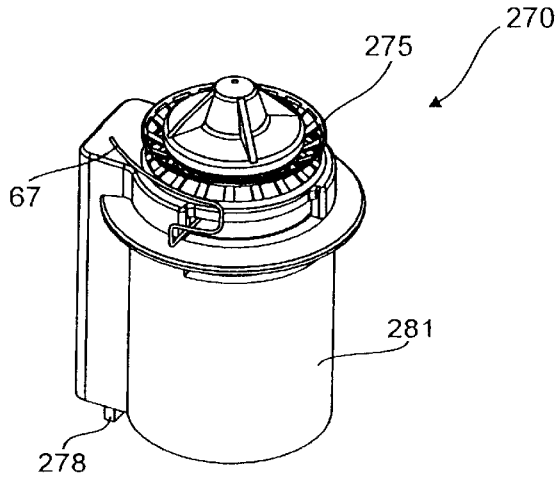
FIG. 16A is a perspective view of an auto-tensioner module which combines a thread length encoder and a tensioning assembly.
Figure 16B:
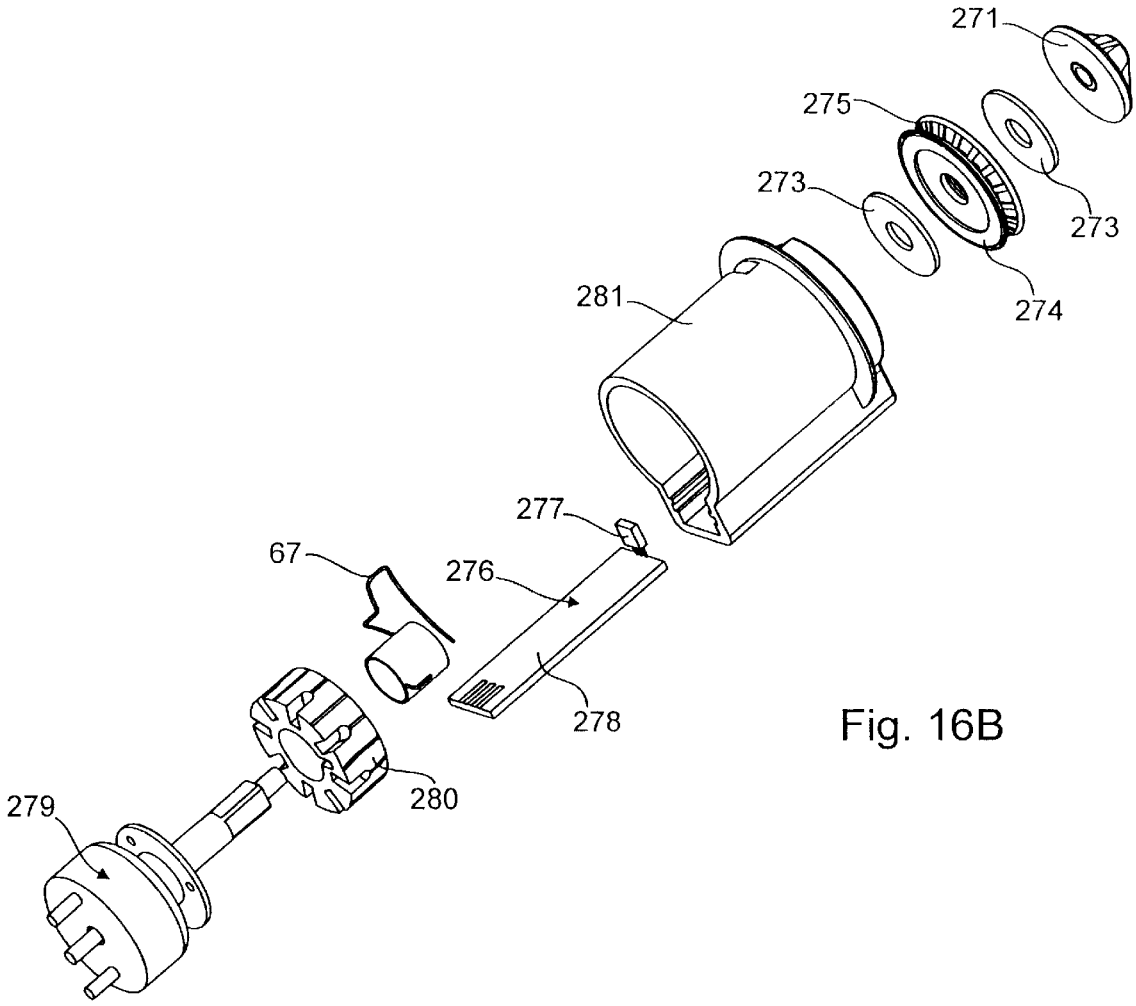
FIG. 16B is an exploded perspective view of the auto-tensioner module in FIG. 16A.
Figure 16C:
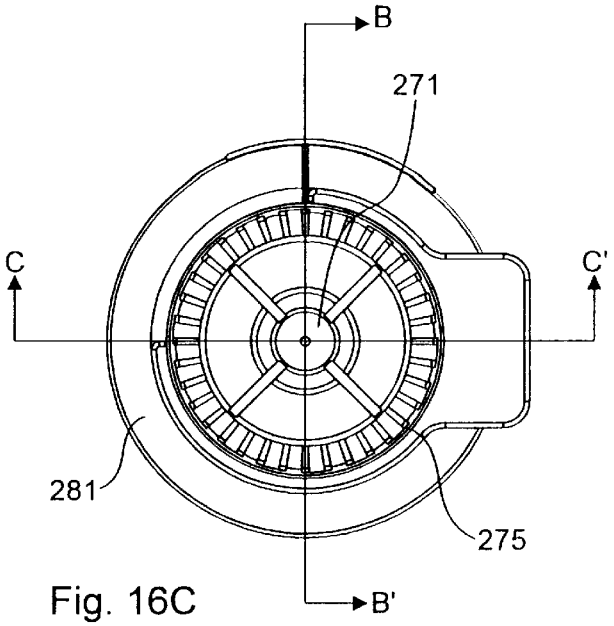
FIG. 16C is a top view of the auto-tensioner module in FIG. 16A.
Figure 16D:
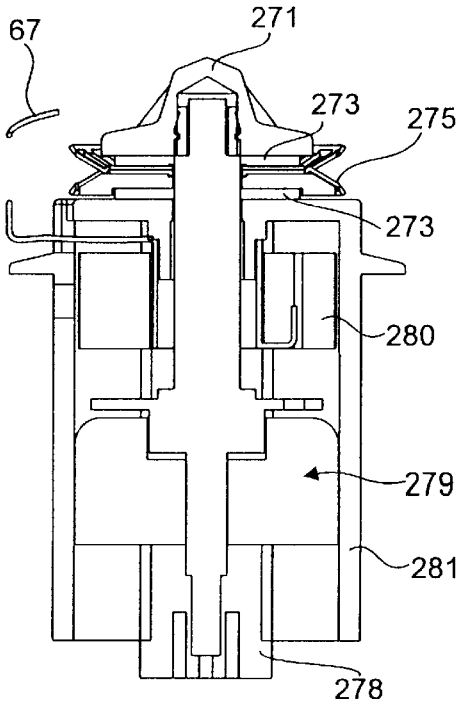
FIG. 16D is a first cutaway view of the auto-tensioner module in FIG. 16A along the line B–B'.
Figure 16E:
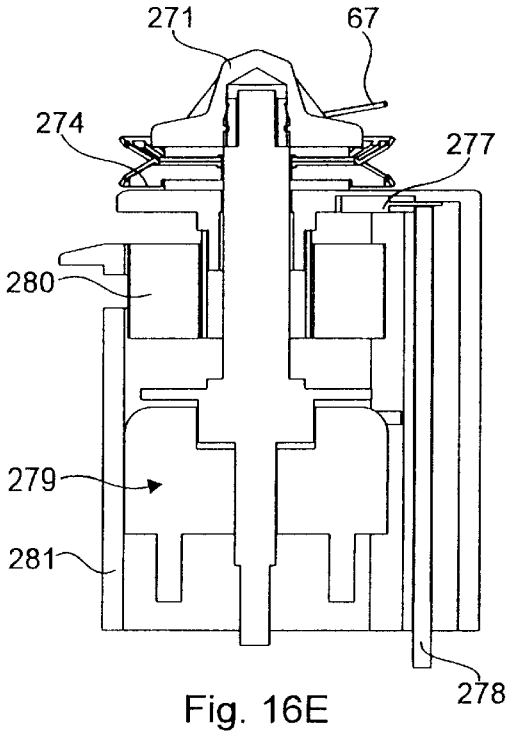
FIG. 16E is a second cutaway view of the auto-tensioner module in FIG. 16A along the line C–C'.
Figure 16F:
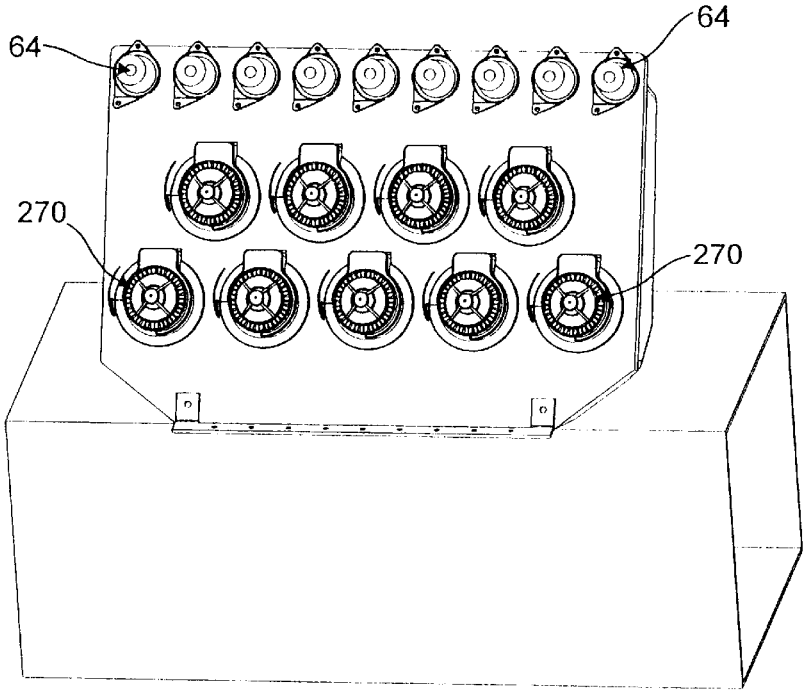
FIG. 16F is a front perspective view showing a portion of a nine needle stitching head which includes the pretensioner and auto-tensioner modules.
Figure 16G:
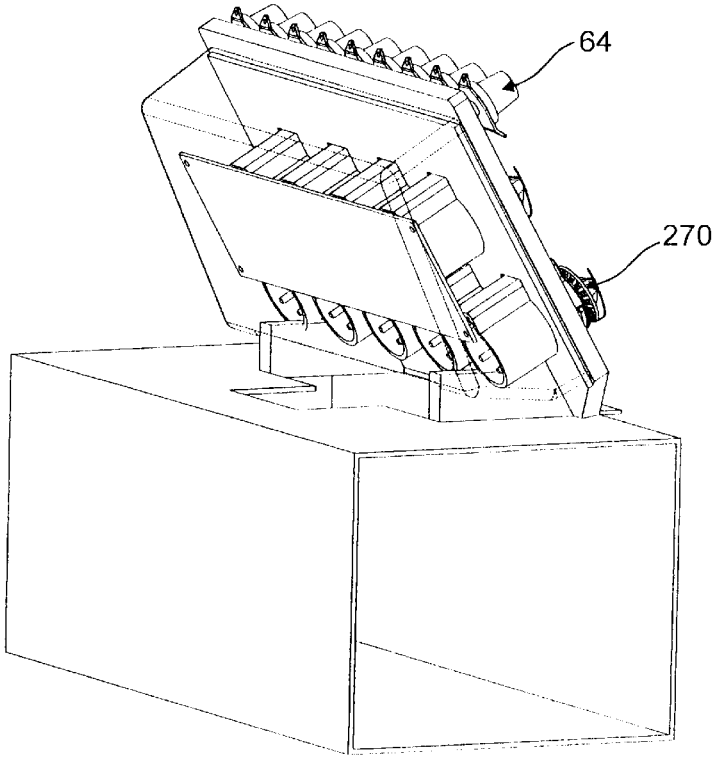
FIG. 16G is a rear perspective view of the portion of the nine needle stitching head also depicted in FIG. 16F.

Referring to FIGS. 16F–G, a portion of the stitching machinery 21 is illustrated. The stitching head 41 for this embodiment has nine threads (not depicted). Each of the nine threads is respectively engaged by the nine auto-tensioner modules 270 and nine pre-tensioners 64. Typically with multi-needle machines each thread has different properties such as color and thickness, and only one thread at a time is used during a stitch job.

Figure 17:
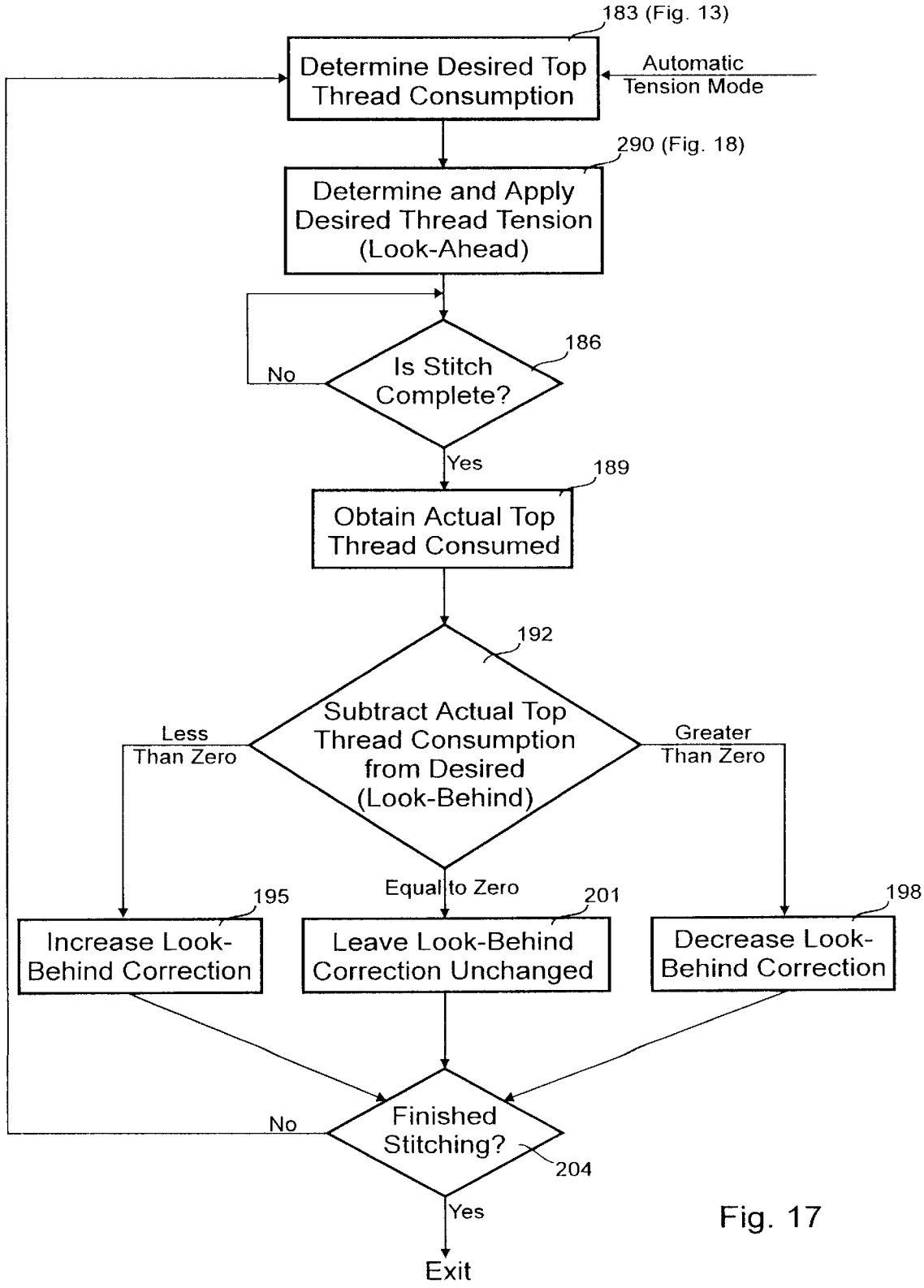
FIG. 17 is a flow diagram depicting the steps for automatically adjusting the thread tension for another embodiment.

In reference to FIG. 17, another embodiment of the automatic tension adjustment is illustrated. This embodiment is largely the same as the embodiment depicted in FIG. 12 except for the removal of step 180 and the addition of step 290. In this embodiment, the desired thread tension is determined and applied in step 290. This step analyzes the particular requirements of the next stitch as compared to the last stitch's requirements and adjusts the tension applied by the tensioning assembly 24 accordingly. An advantage to this embodiment is that it anticipates requiring different thread tension for the next stitch and applies that tension before execution of the next stitch. In contrast, the embodiment in FIG. 12 only corrects thread tension after the stitch has occurred which may result in each stitch being performed at a less optimum thread tension.

Figure 18:
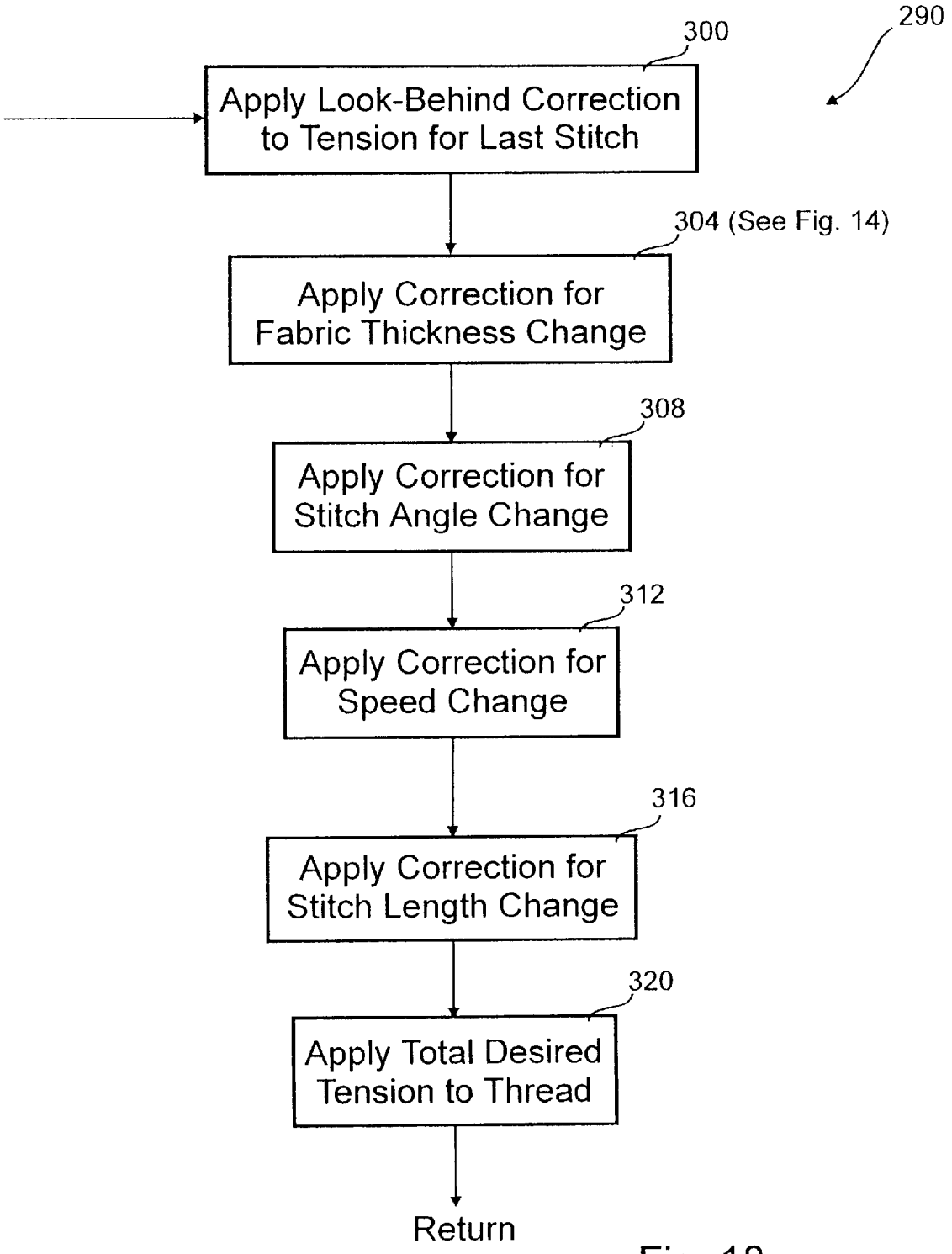
FIG. 18 is a flow diagram showing the steps for determining and applying the desired thread tension for the next stitch based upon certain look-ahead factors.

Referring next to FIG. 18, a detailed flow diagram for determining and applying the desired thread tension of step 290 in FIG. 17 is disclosed. Step 290 determines the desired thread tension by adding the look-behind correction resulting from step 192 (see FIG. 17) and the corrections resulting from analysis of certain factors that can affect the tension required for the next stitch (i.e., look-ahead factors shown in FIG. 13) to the tension used for the last stitch. These look-ahead factors include, but are not limited to, a fabric thickness change, a stitch angle change, a speed change, and a stitch length change.

The first step in determining the desired thread tension is to sum the look-behind correction determined in step 192 (shown in FIG. 17) with the tension used on the last stitch. This value serves as a starting point when determining if the next stitch is different in a way that would warrant adjusting the tension. Feedback is used because any calculation of desired thread tension contains certain inaccuracies since all possible factors that could affect thread tension are often not accounted for. For example, the elasticity of the thread is not factored into these calculations because it would require the operator to measure elasticity for each type and length of thread and enter it into the stitching apparatus 20. That is why the look-behind analysis (i.e., feedback) of step 192 is used to determine a correction for the tension. The result of step 192 is used to determine if the look-behind correction factor should be increased in step 195, decreased in step 198 or remain unchanged in step 201. By feeding back a correction factor representing past inaccuracy in this way, the desired tension calculation for the next stitch should be more accurate. Step 300 adds the tension correction resulting from this process to the tension used for the last stitch.

Changes in fabric thickness 176 may also affect tension in the thread. The method for determining fabric thickness 176 disclosed in FIG. 14 will be used in figuring when the fabric thickness 176 has changed. This change in fabric thickness 176 is used in step 304 to determine how the tension will also change to compensate. Generally, as fabric thickness 176 increases so will the thread usage. To maintain a proper thread length ratio, the resistance applied to the top thread must be decreased by the stitching control system 25 as fabric thickness increases in order to offset the effects of the increased thread usage. Any correction to the tension as a result of this analysis is added to the result from step 300.

As the angle of the stitches in the embroidery pattern change so will the tension applied to the thread. Typically, the embroidery pattern consists of column (i.e., angle change of approximately 180°) and straight-line stitches (i.e., angle change of approximately 0°). Tension on the top thread tends to increase as the stitch angle change increases from 0° to 180°. To combat this tendency, step 308 must multiply the thread tension calculated in step 304 by a stitch angle change correction factor.

When the speed at which the stitches are performed changes the tension on the thread will tend to also change. Increases in stitch speed increase the resistance upon the thread as it passes through the stitching machinery which ultimately results in increased thread tension. Both the tension upon the top thread 50 and bobbin thread 53 are affected by speed changes. Since tension on each thread and the tension ratio between these threads is a determining factor for high quality embroidery, the tension must be maintained over a range of stitch speeds. For a particular configuration of stitching machinery, the top and bobbin thread will be affected differently by changes in stitch speed. The correction calculated in step 312 must compensate for these changes in the tension by changing the tension on the top thread 50. The result from step 308 is multiplied by the thread tension correction resulting from this analysis.

Another factor which changes the tension on the top thread is variance in stitch length 177. Small stitch lengths 177 tend to have more tension than large stitches. The change in tension is believed to result from an elasticity in the thread and because the increased thread consumption in large stitches feeds thread better, among other factors. To compensate for decreases in tension as the stitch length increases a correction is calculated in step 316 and is multiplied by the result of step 312.

The desired thread tension includes, but is not limited to, corrections determined from analyzing the look-behind inaccuracies, fabric thickness change, stitch angle change, speed change, and stitch length change. Step 320 applies this desired thread tension to the tensioning assembly 22 to maintain a proper ratio between the top and bobbin thread. A key advantage to this method is that feedback is used to determine the desired thread tension before the stitch is performed which results in quicker and more accurate reactions to changing stitches in the embroidery pattern.

Figure 19:
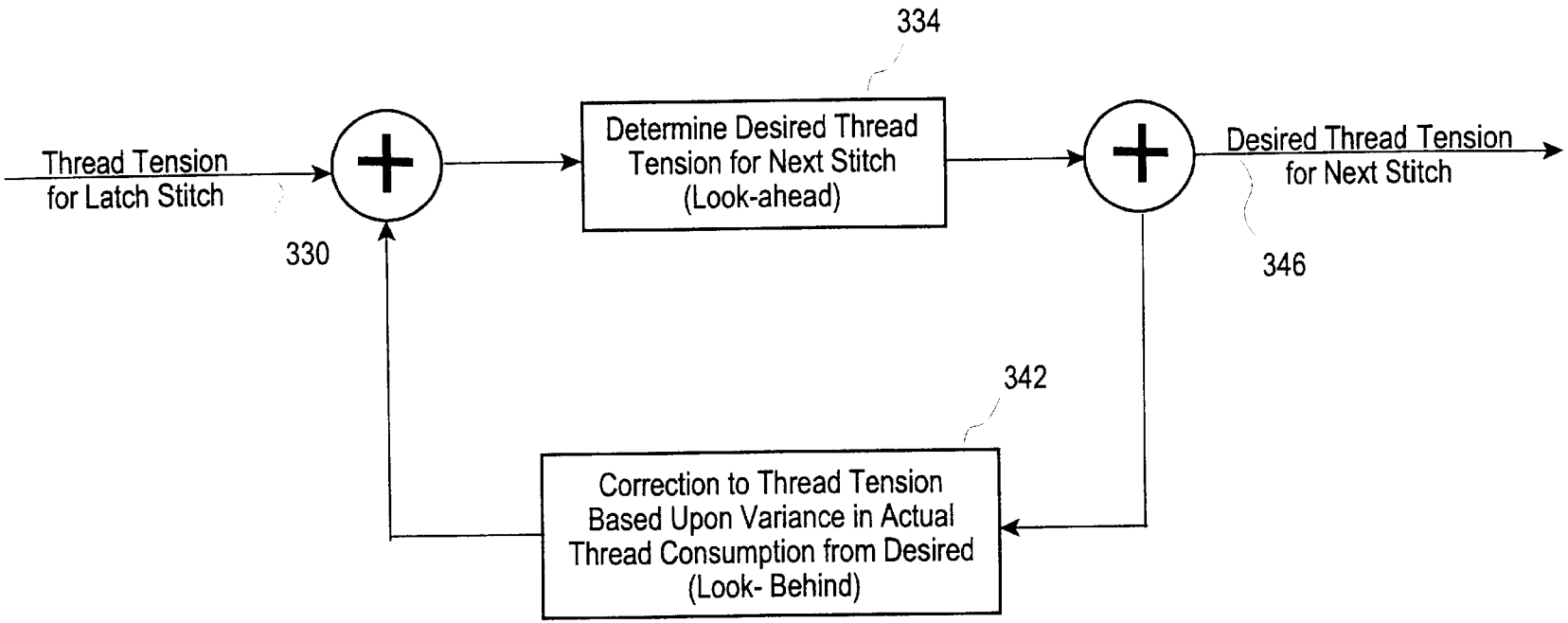
FIG. 19 is a block diagram illustrating a feedback loop representation of the algorithm in FIG. 17.

With reference to FIG. 19, the automatic tension adjustment can be further described in terms of a feedback loop. The input to the feed back loop is the thread tension used for the last stitch 330. The thread tension for the last stitch 330 is added to the look-behind feedback correction generated from analyzing the variance between the desired thread length and the actual thread length for the last stitch in step 342 (i.e., the feedback). Next in step 334, the look-ahead factors such as fabric thickness change, stitch angle change, speed change, and stitch length change are analyzed to determine how tension should change in preparation for the next stitch. The result from step 334 is the desired thread tension for the next stitch denoted by the signal 346. Optimally, the inaccuracies in calculating look-ahead tension in step 334 are compensated for by the feedback provided in step 342 to provide improved accuracy in the desired thread tension for the next stitch for the output signal 346. In other words, more precise tension adjustments are possible by use of feedback in step 342 to counteract the inaccuracy inherent in calculating the look-ahead tension for the next stitch in step 334.

Figure 20:
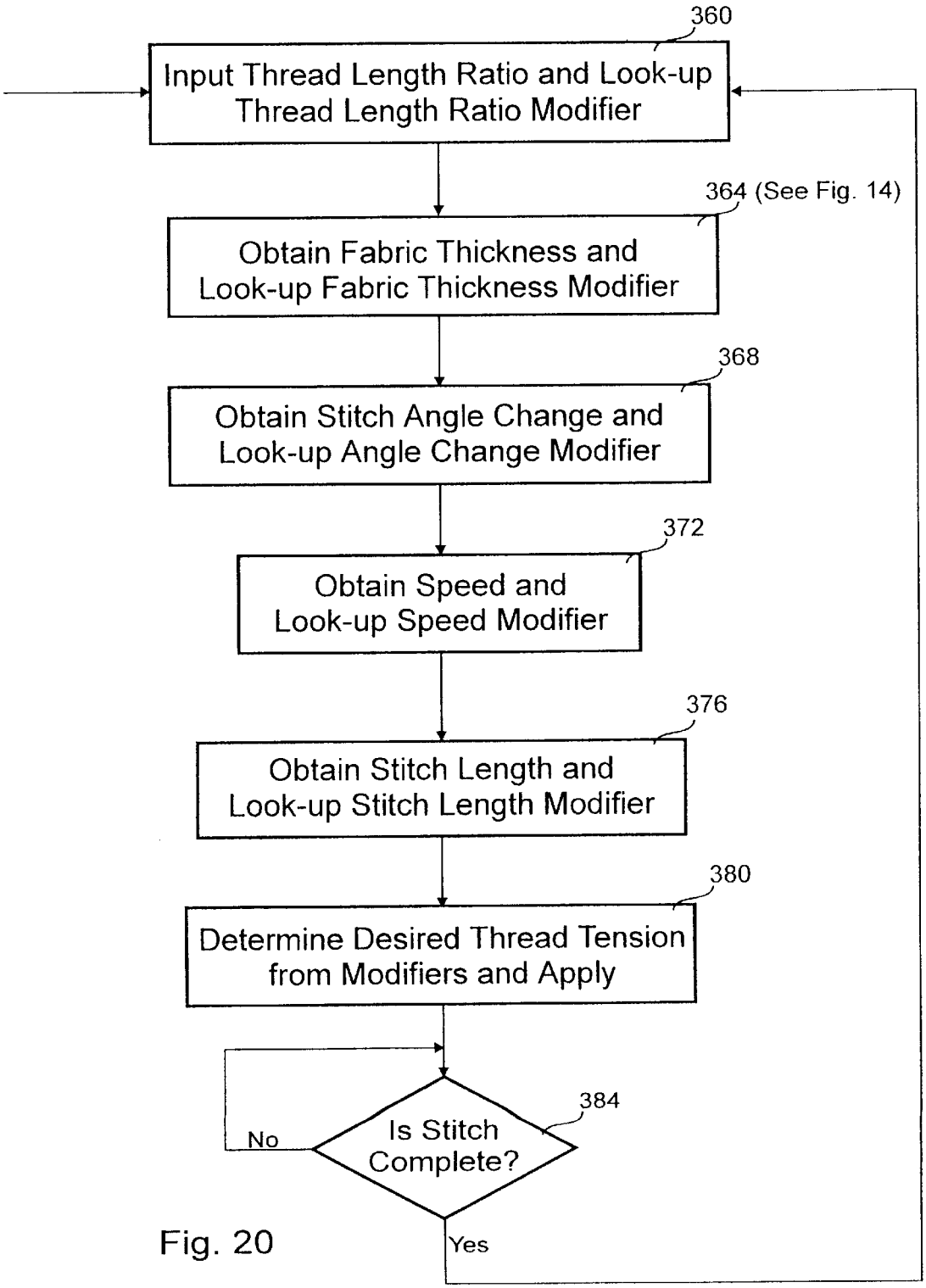
FIG. 20 is a flow diagram showing another embodiment of the present invention which determines the desired thread tension for the next stitch based upon certain look-ahead factors and lookup tables without the assistance of feedback.

Referring to FIG. 20, another embodiment of the automatic tension adjustment of this invention is disclosed. Feedback is not used in this embodiment to determine desired thread tension because when the accuracy in determining the desired thread tension for the next stitch becomes nearly perfect, the improved accuracy provided by the feedback can be unnecessary. Determining the desired thread tension for the next stitch takes steps of: (1) receiving the thread length ratio from the operator input device 24 and using a look-up table to determine the length ratio modifier in step 360, (2) obtaining the fabric thickness and referring to a look-up table to determine the fabric thickness modifier in step 364, (3) obtaining the stitch angle change and looking-up the angle change modifier in step 368, (4) obtaining speed for the next stitch and looking-up the speed modifier in step 372, (5) obtaining stitch length and looking-up the stitch length modifier in step 376, (6) determining the desired thread tension for the next stitch from the modifiers determined in steps 360, 364, 368, 372, 376 and applying that tension to the thread in step 380, and (7) beginning the process over again after completion of one stitch in step 384 at the tension calculated in step 380. If additional accuracy is needed, more factors could be used when calculating the desired thread tension in step 380.

Figure 21:
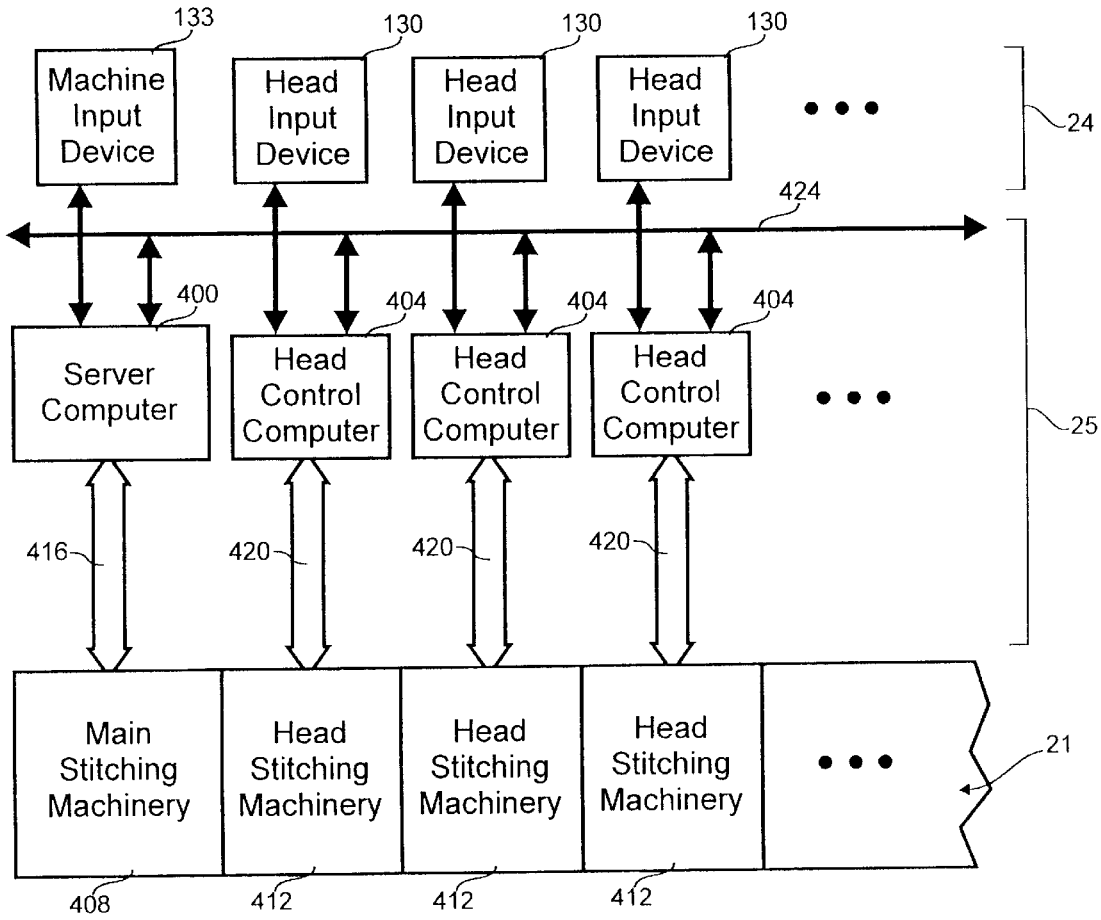
FIG. 21 is a block diagram illustrating the stitching apparatus which shows the interrelationship between the stitching control system, operator input devices and stitching machinery.

Next referring to FIG. 21, an architecture for the stitching control system 25 as it interacts with the stitching machinery 21 is disclosed. The main portion of the stitching machinery 408 is connected to a server computer 400 which receives commands from a machine input device 133 (described in FIG. 8B). In a similar way, the head stitching machinery 412 is supervised by a head control computer 404 which receives commands from a head input device 130 (described in FIG. 8A). The server computer 400 communicates via an interface bus 424 to each head control computer 404.

The server computer 400 performs global calculations in a central location and passes the resulting parameters to each head 41 along with other tasks. Functions performed by the server computer 400 include, but are not limited to, interpreting the pattern received from the removable disk 136, calculating desired thread consumption for each head 41, calculating the stitch length of each stitch, maintaining statistical information on each head 41, and in one embodiment, controlling the X, Y, Z motion between the needle 34 and the fabric 28.

Each head 41 in a multi-head stitching apparatus has a head control computer 404. The head control computer 404 is connected to the head input device 130 and controls the operation of the head stitching machinery 412 and performs calculations not done by the server computer 400. A number of wires serve as an interface between the head control computer 404 and the head stitching machinery 412. These wires are denoted as a bus 420 in FIG. 21. Among other things, the head control computer regulates the tensioning assembly to achieve the desired thread tension or thread length ratio as commanded by the operator 90 through the head input device 130. All head control computers 404 communicate with the server computer 400 by way of the interface bus 424.

The interface bus 424, which connects the server computer 400 with each head control computer 404, is bidirectional which allows data to flow back and forth between the computers. The software residing in each computer can use this interface to query other computers for information as needed. Preferably, the interface bus 424 is configured serially to reduce the amount of wires that would extend to each head 41, but this interface could also be, but is not limited to, a parallel bus, an optical bus or a radio link.

Figure 22:
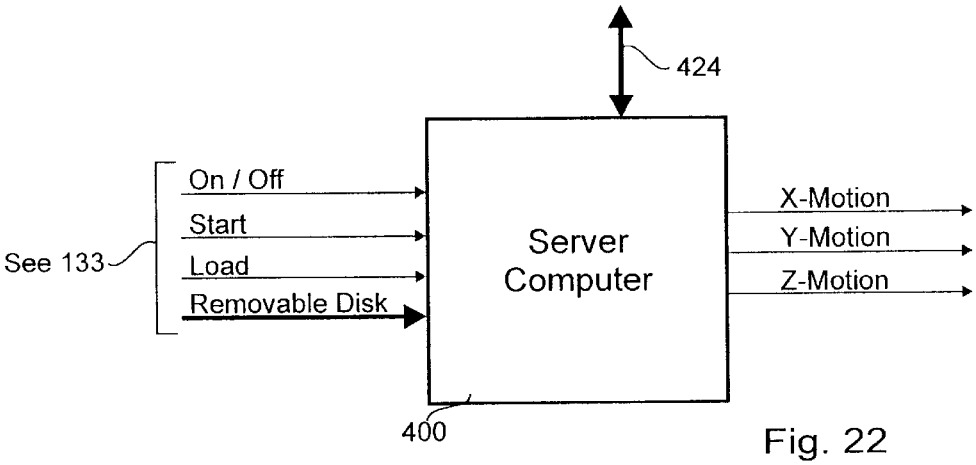
FIG. 22 is a block diagram depicting a server portion of the stitching control system.

In reference to FIG. 22, a block diagram of the server computer 400 is illustrated. Signals are received from the machine input device 133 which is used to determine how to move the fabric hoop 26 in the X and Y directions and the needle 34 in the Z direction. The server computer 400 also analyzes the stitch pattern information received from the removable disk to determine the desired thread consumption which is passed to the head control computers 404 by way of the interface bus 424.

Figure 23:
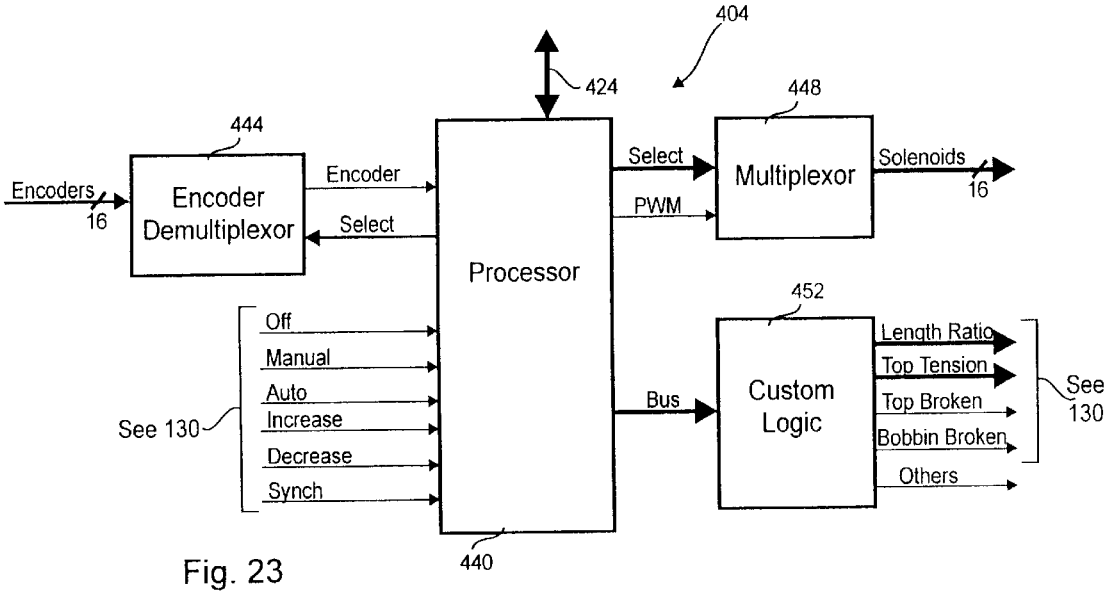
FIG. 23 is a block diagram showing a head control portion of the stitching control system.

Referring to FIG. 23, a head control computer 404 is shown in block diagram form. A central processing unit (CPU) 440 takes the information from the operator input device 24 and the thread length encoders 23 to control the solenoids 118 within the tensioning assemblies 22 along with a number of status indicators.

The status indicators are located on the operator input device 24 and include the length ratio readout 144, top tension readout 143, top thread break indicator 155, and bobbin thread break indicator 158. A custom logic block 452 provides outputs which activate the status indicators under the command of the processor 440.

A encoder demultiplexor block 444 receives the signals from a number of thread length encoders 23. When determining thread consumed, the processor 440 selects a desired thread length encoder signal via the encoder demultiplexor block 444. In this way, the processor 440 can select each encoder signal when determining the amount of thread actually consumed.

The processor 440 must be capable of controlling the solenoids 118 in each tensioning assembly 22 when changing the tension on the thread. A multiplexor block 448 takes the single pulse width modulated signal from the processor 440 and directs it to a selected solenoid. This process allows the processor 440 to change the tension in the thread which is currently being used to perform the stitching.

The forgoing description of the invention has been presented for the purposes of illustration and description and is not intended to limit the invention. Variations and modifications commensurate with the above description, together with the skill or knowledge of the relevant art, are within the scope of the present invention. The embodiments described herein are further intended to explain the best mode known for practicing the invention and to enable those skilled in the art to utilize the invention in such best mode or other embodiments, with the various modifications that may be required by the particular application or use of the invention. It is intended that the appended claims be construed to include alternative embodiments to the extent permitted by the prior art.

What is claimed is:

1. An apparatus for stitching fabric while automatically controlling tension applied to thread used in the stitching, comprising:

first means for supplying information related to actual length of thread used for at least one stitch;

a tensioning assembly for tensioning the thread that is used in stitching the fabric with the at least one stitch; and second means responsive to at least said first means for enabling stitching and for controlling said tensioning assembly;

wherein said second means determines a value related to said desired thread length using a first factor related to desired thread length, with said value related to said desired thread length being dependent on at least a first predetermined factor different from said first factor, said first predetermined factor relating to a speed of the stitch in which, as said speed increases, said first predetermined factor changes in a predetermined direction.

2. An apparatus, as claimed in claim 1, wherein:

said first factor includes information related to a top thread length and a bobbin thread length of at least one stitch.

3. An apparatus, as claimed in claim 1, wherein:

said second means includes means for ascertaining a difference between said actual length of the thread used for the at least one stitch and said desired thread length.

4. An apparatus, as claimed in claim 1, wherein:

said value related to said desired thread length depends on a second predetermined factor that relates to an angle change between stitches in which, as said angle change increases, said second predetermined factor also increases.

5. An apparatus, as claimed in claim 1, wherein:

said value related to said desired thread length depends on a second predetermined factor that relates to a length of the stitch in which, as said length increases, said first predetermined factor decreases.

6. An apparatus, as claimed in claim 1, wherein:

said tensioning assembly dynamically adjusts tension on a top thread a plurality of times during each stitch.

7. An apparatus, as claimed in claim 1, wherein:

said first means comprises a thread length encoder.

8. An apparatus, as claimed in claim 1, wherein:

said second means includes processing means and transducer means, and said tensioning assembly includes a housing and an encoder, with said encoder and said transducer means being supported using said housing and said processing means being spaced from said housing.

9. An apparatus, as claimed in claim 8, wherein:

said transducer means includes a solenoid.

10. An apparatus for stitching fabric while automatically controlling tension applied to thread used in the stitching, comprising:

first means for supplying information related to actual length of thread used for at least one stitch;

a tensioning assembly for tensioning the thread that is used in stitching the fabric with the at least one stitch; and second means responsive to at least said first means for enabling stitching and for controlling said tensioning assembly, said second means including a plurality of processors and a first head stitching machine, said plurality of processors including a server processor and a first head control processor and in which said first head control processor operates with said first head stitching machine and inputs data to said server for use by said server processor in controlling stitching by said first head stitching machine;

wherein said second means determines a value related to said desired thread length using a first factor related to desired thread length, with said value related to said desired thread length being dependent on at least one predetermined factor different from said first factor.

11. An apparatus for stitching fabric while automatically controlling tension applied to thread used in the stitching, comprising:

first means for supplying information related to actual length of thread used for at least one stitch;

second means for providing a first factor related to desired thread length, said second means including first display means for indicating a relationship between a top thread length and a bobbin thread length of at least one stitch;

a tensioning assembly for tensioning the thread that is used in stitching the fabric with the at least one stitch; and third means responsive to said first means and said second means for enabling stitching and for controlling said tensioning assembly;

wherein said third means determines a value related to said desired thread length, with said value related to said desired thread length being dependent on at least one predetermined factor different from said first factor.

12. An apparatus, as claimed in claim 11, wherein:

said second means includes second display means for indicating tension of at least one of said top thread and said bobbin thread.

13. An apparatus, as claimed in claim 11, wherein:

said second means includes at least a first control member for changing said relationship between said top thread length and said bobbin thread length.

14. An apparatus, as claimed in claim 1, wherein:

said second means enables stitching of a second stitch after the first stitch using said information related to said actual length of thread and said value related to said desired thread length.

15. A method for stitching at least a first stitch using thread, comprising:

determining at least a first control output by a stitching control system using at least a desired length of said first stitch;

applying said first control output to a tensioning assembly for adjusting tension of the thread to a first tension;

stitching a first portion of said first stitch using said first tension;

adjusting tension of the thread to a second tension, different from said first tension, while said first stitch is being stitched; and stitching a second portion of said first stitch using said second tension.

16. A method, as claimed in claim 15, wherein:

said step of determining said first control output includes providing to said stitching control system a value related to a stitch angle change.

17. A method for stitching a pattern having at least a first stitch and a second stitch using thread, comprising:

obtaining a first magnitude of a first factor related to each of the first and second stitches used by a stitching control system;

determining a first control output by said stitching control system using at least said first magnitude of said first factor, said step of determining said first control output including providing to said stitching control system a value related to stitch speed;

applying said first control output to a tensioning assembly for adjusting tension of the thread to a first tension;

stitching the first stitch of the pattern having a first desired thread length using said first tension;

determining a second control output using at least said first magnitude of said first factor, wherein said second control output is different from said first control output;

applying said second control output to said tensioning assembly for adjusting the tension of the thread to a second tension; and stitching the second stitch of the pattern having a second desired thread length and in which the first and second desired thread lengths are different.

18. A method, as claimed in claim 15, wherein:

said step of applying said first control output to said tensioning assembly includes adjusting tension of at least one of a top thread and a bobbin thread.

19. A method for stitching a pattern having at least a first stitch and a second stitch using thread, comprising:

obtaining a first magnitude of a first factor related to each of said first and second stitches for use by a stitching control system, said step of obtaining said first magnitude of said first factor including inputting said first magnitude using operator input means;

determining a first control output by said stitching control system using at least said first magnitude of said first factor;

applying said first control output to a tensioning assembly for adjusting tension of the thread to a first tension;

stitching said first stitch of the pattern having a first desired thread length using said first tension;

determining a second control output using at least said first magnitude of said first factor, wherein said second control output is different from said first control output;

applying said second control output to said tensioning assembly for adjusting tension of the thread to a second tension; and stitching said second stitch of the pattern having a second desired thread length and in which said first and second desired thread lengths are different.

20. A method, as claimed in claim 19, wherein:

said inputting step includes providing a display of at least one of a ratio between a top thread length and a bottom thread length and a tension of at least one of the top thread and the bobbin thread.

21. A method, as claimed in claim 15, wherein:

said step of determining said first control output includes accessing predetermined information stored in memory related to said desired length of said first stitch.

22. An apparatus for stitching fabric while automatically controlling tension applied to thread used in the stitching, comprising:

an operator input means including at least a first display means for indicating a relationship between top thread length and bobbin thread length;

a tensioning assembly for tensioning the thread that is used in stitching the fabric; and a stitching control system responsive to said operator input device for enabling stitching and for controlling said tensioning assembly.

23. An apparatus, as claimed in claim 22, wherein:

said operator input device includes second display means for indicating tension of at least one of a top thread and a bobbin thread.

24. An apparatus, as claimed in claim 22, wherein:

said operator input means includes at least a first control member for changing a ratio between the top thread length and the bobbin thread length.

25. An apparatus, as claimed in claim 22, wherein:

said operator input means includes an automatic mode and a manual mode, and in which said automatic mode allows changing a ratio between the top thread length and the bobbin thread length, and said manual mode allows for changing at least one of top thread tension and bottom thread tension.

26. A method for stitching a pattern having a plurality of stitches, with each stitch including a top thread length and a bobbin thread length, comprising:

providing a stitching control system;

providing operator input means;

inputting a first factor related to top thread length and bobbin thread length to said stitching control system using said operator input means;

obtaining a ratio between said top thread length and said bobbin thread length by adjusting tension applied to the thread using a control output applied to a tensioning assembly; and stitching at least one stitch of the pattern.

27. A method, as claimed in claim 26, wherein:

said control output dynamically changes a plurality of times during said stitching step.

28. A method, as claimed in claim 26, further including:

stitching another stitch and in which said obtaining step and adjusting of tension is conducted before said stitching of said another stitch.

29. A method, as claimed in claim 26, further including:

stitching another stitch and in which said control output includes a first magnitude and a second magnitude, with said first magnitude being determined before conducting said step of stitching said one stitch and said second magnitude being determined before conducting said step of stitching said another stitch and after conducting said step of stitching said one stitch.

30. A method, as claimed in claim 26, wherein:

said control output depends on an actual thread length obtained using said stitching control system.

31. A method, as claimed in claim 26, wherein:

said control output applied to said tensioning assembly is related to at least one of: stitch speed, stitch angle change, fabric thickness and stitch length.

32. A method, as claimed in claim 26, wherein:

said adjusting tension includes adjusting tension of a top thread while tension remains constant for a bobbin thread.

33. A method, as claimed in claim 26, wherein:

said control output is related to orientation of said one stitch as compared to orientation of one or more prior stitches.

34. A method, as claimed in claim 26, wherein:

said control output depends on predetermined information stored in memory related to top thread length.

35. A method, as claimed in claim 26, wherein:

said inputting step includes displaying a first indication related to said ratio.

36. A method, as claimed in claim 35, wherein:

said inputting step includes displaying a second indication related to tension of at least one of a top thread and a bobbin thread.

37. A method, as claimed in claim 26, wherein:

said inputting step includes engaging a first control member to change said ratio.

38. A method for controlling thread tension when more than one thread is being stitched at one time, comprising:

providing a plurality of stitching machines together having a number of heads, including a first head, each head for stitching thread in fabric;

determining a desired thread tension based on stitching fabric by said first head;

inputting information related to said desired thread tension based on said determining step;

applying automatically said information to each of said number of heads after said inputting step; and stitching thread for each of said heads having said desired thread tension.

39. A method, as claimed in claim 38, wherein:

said determining step includes observing by an operator said desired tension during stitching using said first head.

40. A method, as claimed in claim 38, wherein:

said inputting step includes providing said information to one of said stitching machines using an input device.

41. A method, as claimed in claim 38, wherein:

said applying step includes networking said information using an interface bus interconnected to each of said stitching machines.

42. A method for stitching a pattern having at least a first stitch and a second stitch using thread, comprising:

determining a first control output using a first stitch length modifier that has a value depending on a length of a first stitch;

controlling a tensioning assembly using said first control output to provide a first tension associated with said first stitch, said controlling step including compensating for less tension in said first stitch due to said length thereof;

stitching said first stitch having said first length;

determining a second control output using a second stitch length modifier that has a value depending on a second length of a second stitch;

controlling said tensioning assembly using said second control output to provide a second tension associated with said second stitch, said controlling step including compensating for increased tension in said second stitch due to said length thereof and with said second length of said second stitch being less than said first length of said first stitch; and stitching said second stitch having said second length after stitching said first stitch.

43. A method, as claimed in claim 42, wherein:

said step of determining said first control output includes ascertaining a desired length for said first stitch.

44. A method, as claimed in claim 43, wherein:

said step of determining said first control output includes obtaining an actual thread length.

45. A method, as claimed in claim 42, wherein:

said second stitch length modifier is used in decreasing tension from said first tension for said first stitch to said second tension for said second stitch.

46. A method, as claimed in claim 15, wherein:

said first portion is toward a beginning of said first stitch and said second portion is toward an end of said first stitch and in which said second tension is greater than said first tension.

* * * * *